US008613691B2

(12) United States Patent
Bosecker et al.

(10) Patent No.: US 8,613,691 B2
(45) Date of Patent: Dec. 24, 2013

(54) DYNAMIC LOWER LIMB REHABILITATION ROBOTIC APPARATUS AND METHOD OF REHABILITATING HUMAN GAIT

(76) Inventors: Caitlyn Joyce Bosecker, Billerica, MA (US); Hermano Igo Krebs, Watertown, MA (US)

( * ) Notice: Subject to any disclaimer, the term of this patent is extended or adjusted under 35 U.S.C. 154(b) by 0 days.

(21) Appl. No.: 13/191,105

(22) Filed: Jul. 26, 2011

(65) Prior Publication Data

US 2011/0288455 A1 Nov. 24, 2011

Related U.S. Application Data

(63) Continuation of application No. 12/762,282, filed on Apr. 16, 2010.

(60) Provisional application No. 61/169,939, filed on Apr. 16, 2009.

(51) Int. Cl.
*A63B 71/00* (2006.01)
*A63B 22/02* (2006.01)

(52) U.S. Cl.
USPC ..... 482/54; 482/69; 482/8

(58) Field of Classification Search
USPC ..... 482/54, 69, 70, 52, 57; 601/29, 34, 35
See application file for complete search history.

(56) References Cited

U.S. PATENT DOCUMENTS 4,204,673 A * 5/1980 Speer, Sr. ..... 482/5
5,336,146 A * 8/1994 Piaget et al. ..... 482/54
5,372,561 A 12/1994 Lynch
5,538,489 A * 7/1996 Magid ..... 482/54
5,569,129 A 10/1996 Seif-Naraghi et al.
5,607,376 A * 3/1997 Magid ..... 482/54
6,162,151 A 12/2000 Tani et al.
6,273,844 B1 8/2001 Kelsey et al.
6,461,279 B1 10/2002 Kuo
6,689,075 B2 2/2004 West
6,811,519 B2 * 11/2004 Kuo ..... 482/54
6,893,383 B1 * 5/2005 Chang et al. ..... 482/54
7,544,172 B2 * 6/2009 Santos-Munne et al. ..... 601/5
7,621,850 B2 * 11/2009 Piaget et al. ..... 482/54
7,803,125 B2 * 9/2010 Santos-Munne et al. ..... 601/5
2004/0192514 A1 9/2004 Piaget et al.

(Continued)

FOREIGN PATENT DOCUMENTS

WO WO 2007058512 A1 * 5/2007

OTHER PUBLICATIONS

Bosecker et al. "MIT-Skywalker." Rehabilitation Robotics, IEEE International Conference. ICORR. (2009):542-549.

(Continued)

*Primary Examiner* — Stephen Crow
(74) *Attorney, Agent, or Firm* — Mintz Levin Cohn Ferris Glovsky and Popeo, P.C.

(57) ABSTRACT

A robotic rehabilitation apparatus and method provide subjects with lower limb gait impairment, gait therapy before subjects are able to walk independently, or are able to control their legs or stand unaided. The apparatus is constructed and arranged to take advantage of natural gravitational force and musculo-skeletal dynamics of therapy subjects, and to replicate gait in subjects without manual or mechanical intervention to lift subjects' legs and feet. The apparatus and method provide the appropriate dynamic and sensory inputs to muscle groups occurring during normal gait that are critical to gait rehabilitation.

17 Claims, 24 Drawing Sheets

(56) References Cited

U.S. PATENT DOCUMENTS

| | | | | |
|---|---|---|---|---|
| 2006/0247104 | A1 | 11/2006 | Grabiner et al. | |
| 2007/0275830 | A1* | 11/2007 | Lee et al. | 482/54 |
| 2009/0318267 | A1* | 12/2009 | Park et al. | 482/8 |
| 2010/0268129 | A1 | 10/2010 | Park | |
| 2010/0298102 | A1* | 11/2010 | Bosecker et al. | 482/54 |

OTHER PUBLICATIONS

Collins et al. "A Three-Dimensional Passive-Dynamic Walking Robot with Two Legs and Knees." *Int. J. Robotics Res.* 20.7(2001):607-615.

Hesse et al. "Treadmill Training with Partial Body Weight Support Compared with Physiotherapy in Nonambulatory Hemiparetic Patients." *Stroke*. 26.6(1995):976-981.

Hidler et al. "Alterations in Muscle Activation Patterns During Robotic-Assisted Walking." *Clin. Biomech*. 20(2005):184-193.

Hidler et al. "Multicenter Randomized Clinical Trial Evaluating the Effectiveness of the Lokomat in Subacute Stroke." *Neurorehab. Neural Repair*. 23.1(2009):5-13.

Hidler et al. "Strength and Coordination in the Paretic Leg of Individuals Folllowing Acute Stroke." *IEEE Transactions on Neural Systems and Rehabilitation Eng*. 15.4(2007):526-534.

Hornby et al. "Enhanced Gait-Related Improvements after Therapist-Versus Robotic-Assisted Locomotor Training in Subjects with Chronic Stroke." *Stroke*. 39(2008):1786-1792.

Jezernik et al. "Robotic Orthosis Lokomat: A Rehabilitation and Research Tool." *Int. Neuromod. Soc*. 6.2(2003):108-115.

Krebs et al. "Robot-Aided Neurorehabilitation." *IEEE Transactions on Rehabilitation Engineering*. 6.1(1998):75-87.

Lamontagne et al. "Faster is Better: Implications for Speed-Intensive Gait Training after Stroke." *Stroke*. 35(2004):2543-2548.

McGowan et al. "Independent Effects of Weight and Mass on Plantar Flexor Activity During Walking: Implications for their Contributions to Body Support and Forward Propulsion." *J. Appl. Physiol*. 105(2008):486-494.

Mehrholz et al. "Electromechanical-Assisted Training for Walking after Stroke." *Cochrane Lib*. 1(2009):1-42.

Pohl et al. "Repetitive Locomotor Training and Physiotherapy Improve Walking and Basic Activities of Daily Living After Stroke." *Clin. Rehab*. 21(2007):17-21.

Pohl et al. "Speed-Dependent Treadmill Training in Ambulatory Hemiparetic Stroke Patients." *Stroke*. 33(2002):553-558.

Roy et al. "Robot-Aided Neurorehabilitation: A Novel Robot for Ankle Rehabilitation." *IEEE Transactions on Robotics*. (2009):1-14.

Visintin et al. "A New Approach to Retrain Gait in Stroke Patients Through Body Weight Support and Treadmill Stimulation." *Stroke*. 29.6(1998):1122-1128.

Wilson et al. "Equipment Specifications for Supported Treadmill Ambulation Training." *J. Rehab. Res. Dev*. 37.4(2000):415-422.

* cited by examiner

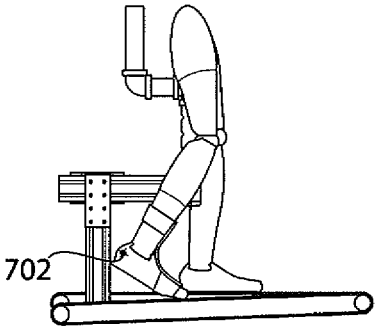
Fig. 16B-(1)
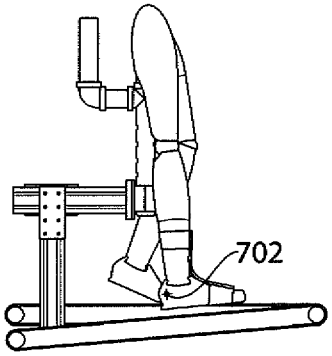
Fig. 16B-(2)
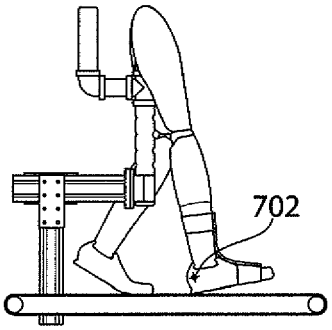
Fig. 16B-(3)
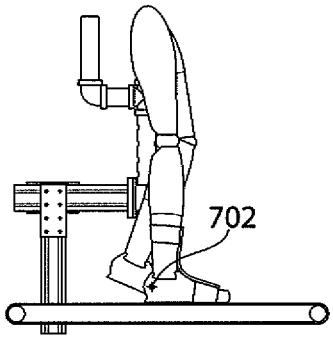
Fig. 16B-(4)
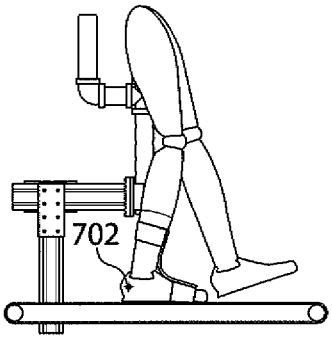
Fig. 16B-(5)
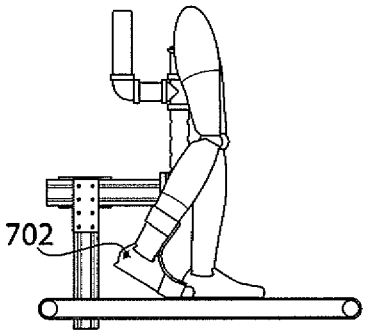
Fig. 16B-(6)

DYNAMIC LOWER LIMB REHABILITATION ROBOTIC APPARATUS AND METHOD OF REHABILITATING HUMAN GAIT

PRIOR APPLICATIONS

This patent application claims priority to and is a continuation of U.S. patent application Ser. No. 12/762,282, filed Apr. 16, 2010, which claims priority to U.S. provisional patent application Ser. No. 61/169,939, filed Apr. 16, 2009, both of which are incorporated by reference herein in their entireties.

TECHNICAL FIELD OF THE INVENTION

The invention provides a dynamic and interactive lower limb robotic apparatus for and method of exercising, rehabilitating, and evaluating lower limb movements of persons with gait impairment.

BACKGROUND

The ability to walk is important for independent living and when neurological or other injury affects this capacity, gait therapy is the traditional approach to re-train the nervous system. The approximately 5.8 million stroke survivors, and an additional 700,000 strokes occurring each year, many requiring gait therapy, illustrate the importance of this problem. In addition to stroke, many other neurological conditions and orthopedic injuries lead to significant gait impairment. Individuals with these conditions may be able to regain gait function through physical therapy.

Utilizing mechanical devices to deliver gait therapy is not a new idea and several devices have been developed for this purpose. The most common mechanical device is the treadmill. Treadmills reduce the amount of space required for therapy, in comparison to ground walking therapy, and encourage patients to maintain a constant gait velocity. While research indicates that treadmill gait therapy does not have a detrimental impact and improves training efficiency, and, in some cases, subjects who completed treadmill therapy regained more function compared to traditional physiotherapy techniques, treadmill therapy still requires a therapist to monitor pelvis movement and a second or third therapist to propel the leg or legs forward. Robotic rehabilitation devices for lower limb therapy have been built to attempt to automate the therapy process. Prior art robotic devices that have shown reliable outcomes include the Gait Trainer I (Reha-Stim)[1], which is an end-effector based robot incorporating an adjustable body weight system and sliding foot plates secured to the patient's feet to impose a mechanically-fixed pattern of foot motion. Another prior art device includes the Lokomat (Hocoma)[2], which includes a treadmill, an adjustable body weight support and imposes a fixed kinematic gait pattern determined from healthy subjects. These robotic devices do not reproduce the appropriate dynamic sensory input that occurs during normal gait and that is critical for gait rehabilitation. Neural inputs required to re-gain leg movement and balance include appropriate heel strike, toe-off, and swing phase during which gravity accelerates the foot towards the ground. However, prior art devices employing fixed foot motion or fixed kinematic gait patterns do not satisfy one or more of these neural inputs associated with normal gait.

[1] Pohl M, Werner C, Holzgraefe, et al. Repetitive locomotor training and physiotheraphy improve walking and basic activities of daily living after stroke: a single-blind, randomized mulicentre trial (Deutsche GA Ingtrainer-Studie, DEGAS.) *Clinical Rehabilitation,* 21: 17-27 (2007); Mehrholz, J, Werner C, Kugler J, Pohl M., Electromechanical-assisted training for walking after stroke (Review), *The Cochrane Collaboration*, Issue 4, (2007)

[2] Hidler J, Wisman W, Neckel N. Kinematic trajectories while walking within the Lokomat robotic gait-orthosis. *Clinical Biomechanics.* 23: 1251-1259 (2008); Jesernik S, Colombo G, Keller T, et al. Robotic orthosis Lokomat: a rehabilitation and research tool. *Neuromodulation.* 6: 108-115 (2003).

Thus, it is desirable to provide an interactive rehabilitation robotic device or apparatus for treadmill gait therapy that allows lower limb movement of a subject without the subject restricted to a fixed, rigid kinematic profile. In addition, it is desirable this robotic apparatus permit active participation of the subject and dynamic lower limb movement in response to the creation of a ground clearance that permits leg/foot swing and employs gravity to assist in forward leg/foot propulsion. It is desirable that the apparatus challenges a subject to increase his/her contribution to the leg/foot motion by monitoring the subject's performance and increasing treadmill speed as needed. It is also desirable that the apparatus further enable subject steps with an ecological heel strike. In this manner, the apparatus permits the subject to take advantage of natural gravitational, muscular and skeletal dynamics, while accomplishing toe-off, foot swing, and heel strike phases of a human gait, such that, the appropriate muscle groups of the subject receive the required neural input.

SUMMARY

In general, in one aspect, the invention provides a robotic rehabilitation apparatus that is constructed and arranged to allow subjects with lower limb gait impairment, such as stroke patients or persons with other physical, orthopedic, and neurological impairment, to engage in gait therapy before such patients or subjects are able to walk independently, or are able to control their legs or stand unaided. The apparatus is constructed and arranged to take advantage of natural gravitational and musculo-skeletal dynamics and to replicate gait in therapy subjects without the use of actuators, sensors, or controllers to manipulate directly subjects' legs and feet.

The apparatus according to the invention may include a frame system to which a body weight support (BWS) system may be mounted. The BWS system may be constructed and arranged to support, in part or completely, a subject's weight and to stabilize the subject's trunk. The apparatus may further include a walking surface including two surface foot panels for supporting each foot of a subject and for allowing each foot of the subject to move unaided during gait therapy in response to natural gravitational force and muscular and skeletal dynamics of the subject's body. The foot panels may be constructed and arranged to reproduce a normal gait or a subject's gait by lowering away from and raising toward and contacting the subject's feet. Each foot panel may include one or more actuators configured to lower and to raise the foot panel beneath a subject's foot, and may include a conveyor along its surface for movement of the subject's foot backward when the subject's foot is in contact with the foot panel surface. In one embodiment of the invention, the two-panel walking surface includes a split, two-panel treadmill.

While the BWS system supports a subject above the foot panels, the subject's legs are relaxed and their feet may rest on the surfaces of the foot panels, which are positioned along a horizontal plane substantially parallel to the surface or ground on which the apparatus sits. At this position, the foot panels are in a stationary position and the subject's feet are in the stance position or phase of a gait cycle. The foot panels, however, may be positioned in a stationary position at orientations other than along a horizontal plane substantially parallel to the surface or ground.

Each foot panel may lower behind a subject's foot (heel) to allow gravity and the dynamics of the subject's muscular and skeletal systems to propel the subject's foot forward and to accelerate the subject's foot (heel) toward the surface of the lowered foot panel. Alternatively, each foot panel, e.g., unhinged, may lower and raise substantially vertically, e.g., the foot panel does not lower or raise at or from one of its ends, below the subject's foot. Lowering the foot panel below the subject's foot allows gravity and the subject's muscular and skeletal system dynamics to propel the subject's foot forward. Each foot panel also may raise toward and contact the subject's unsupported foot to raise the subject's foot to the stance phase as the foot panel returns to the stationary position. The foot panels may also raise the subject's leg and foot above the horizontal plane to propel the subject's leg upwards.

While one of the foot panels lowers behind the subject's foot (heel), or lowers substantially vertically, e.g., the foot panel does not lower or raise at or from one of its ends, in a downward manner below the subject's foot (to allow free leg/foot swing forward in response to natural gravitational force), the other foot remains at the stance phase in contact with the foot panel conveyor and the conveyor moves the foot backward. Alternate lowering and raising of the foot panels helps to achieve the dynamics of a subject's forward step, including the toe-off and swing phases of a gait cycle, and the return of the subject's heel to the foot panel surface, including the heel strike phase of the gait cycle. More specifically, each foot panel lowers to allow the subject's foot to move from the stance phase to the toe-off phase at which the subject's leg/foot swings or propels forward and accelerates. At this time, each conveyor of the other foot panel moves the subject's other foot backward to translate the subject's other foot through the stance phase until it reaches the toe-off phase. As one of the foot panels lowers and the subject's foot reaches the toe-off phase, the other foot panel raises to contact and return the subject's other foot to the stance phase as the foot panel returns upward to the stationary position. In effect, the foot panels alternately lower and raise, or, in other words, oscillate, to help to reproduce a subject's normal gait and to achieve and maintain a particular gait pattern.

Movement of the subject's legs and feet via the lowering and rising of the foot panels without manual or mechanical lifting of the subject's legs and feet provides the appropriate dynamic and sensory inputs to muscle groups occurring during normal gait that are critical for gait rehabilitation. The apparatus according to the invention thereby delivers gait therapy without manual and mechanical intervention and takes advantage of the natural gravitational force and the muscular and skeletal dynamics of the subject's limbs that the foot panels allow as the foot panels lower and raise beneath the subject's feet.

The two-panel walking surface or treadmill may be configured and designed to provide adjustable and controllable gait speeds through adjustment and control of the foot panel conveyor speeds. Conveyors may thereby move at the same or distinct speeds, and conveyor speeds may be adjusted and controlled independently or not. In addition, the foot panels may be configured and designed to adjust and control speeds at which the apparatus delivers gait therapy in order to provide greater challenges to a subject as the subject improves their gait. For instance, conveyor speed increases would require increases in a subject's self-generated leg/foot propulsion. The objective of the apparatus and method of the invention is to increase foot panel/treadmill speeds, such that, a subject physically engages as much as possible in self-generated leg/foot propulsion during gait training.

Furthermore, the walking surface may be configured and designed, such that, the two panels lower and raise with different values of impedance. This provides different levels of cushion to the impact of a subject's foot along the foot panels and simulates from very soft to very hard surfaces.

The apparatus may include one or more sensors coupled operatively with the two-panel walking surface or treadmill, and/or the foot panels, to adjust, modulate, and/or control various actions of the foot panels. One or more sensors may couple operatively with the foot panels to adjust and control execution of the movement patterns of the foot panels and, more particularly, to control when each foot panel lowers and raises to help to optimize a subject's gait performance and training. For instance, one or more sensors may help to determine when a subject's leg is backwards along a conveyor at the end of the stance phase and ready for the toe-off phase, and/or when the subject's leg is forward at the completion of the swing phase and ready for landing at the heel strike phase. This would determine when the foot panels should accordingly lower and raise beneath a subject's feet. Further, one or more sensors may couple operatively with the foot panels to adjust and control the speeds of the foot panel/treadmill conveyors, such that, conveyors operate at the same or distinct speeds, and/or are controlled independently or not. In one embodiment of the invention, the one or more sensors couple operatively with the foot panels and the conveyors through a controller and/or a computer or data processing device that receives input signals from the one or more sensors. Such input signals represent data that the controller or computer/data processing device processes for generating and transmitting adaptive and/or controlling output signals to the foot panels or other systems and components of the rehabilitation apparatus. As described below, such sensors may include, but are not limited to, electromyographic (EMG) sensors that record muscle activities, cameras that capture images of a marker located at a subject's ankle, knee or other leg portion designated for tracking, as well as sensors/devices related to brain scanning technology including, for instance, electroencephalography (EEG) or near infrared spectroscopy (NIRS).

In contrast to prior art rehabilitation robotic devices employing a treadmill, the apparatus according to the invention, as mentioned, does not require manually or mechanically lifting a subject's leg/foot. Rather, the apparatus promotes active participation of the subject and takes advantage of gravity to propel a subject's leg forward similar to a pendulum moving forward. More importantly, in contrast to prior art kinematic-based rehabilitation robotic devices, the apparatus does not impose on the subject a specific or rigid kinematic pattern that the subject must follow. The apparatus thereby does not reproduce a non-interactive, non-compliant behavior, as do prior art devices. In contrast, the apparatus according to the invention maximizes the number of weight bearing steps and addresses the need for proper neural inputs that a subject's musculo-skeletal dynamics, including hip extensions and ecological heel strikes, provide. These neural inputs may be achieved with the apparatus by lowering the subject's walking surfaces, rather than lifting the subject's leg, and exploiting gravity and the dynamics of the limbs to assist leg/foot propulsion.

Various implementations of the invention provide one or more of the following advantages or capabilities. Subjects with gait impairment can begin gait therapy earlier in the recovery process and before subjects can walk independently. Early gait therapy can help to reduce the extent and frequency of subjects' compensatory behavior ("bad habits") that subjects develop during therapy, such as, for instance, hip "hiking" and circumduction. During therapy, a subject's gait is not achieved manually or mechanically, but may be highly interactive such that therapy challenges the subject continuously to participate, and the subject's reacquisition of normal leg movements and coordination may be reinforced and may be monitored and quantified continuously. The apparatus can be configured to permit remote gait training by various remote means and to provide the capabilities of autonomous recapitulation of therapy sessions. The apparatus according to the invention can require only a single therapist or aid to deliver or oversee effective gait therapy, and may not require a therapist's or aid's full attention at all times during therapy, thereby permitting a single therapist to work with more than one subject. The apparatus according to the invention can define a relatively compact design to facilitate portability, easy maneuverability, and relocation, e.g., transport through a standard-dimensioned door. Employing a treadmill as the two panel oscillating walking surface, the apparatus can provide gait therapy in confined spaces and can provide an adjustable treadmill surface and body weight support height to accommodate a range of subjects.

BRIEF DESCRIPTION OF THE DRAWINGS

The drawings are not necessarily rendered to scale with emphasis placed upon illustrating particular principles that the specification discusses below.

FIGS. 16A to 16C are schematic diagrams of the apparatus shown in FIGS. 1 and 2 and FIGS. 7A and 7B coupled operatively with one or more cameras;

DETAILED DESCRIPTION

Figure 1:
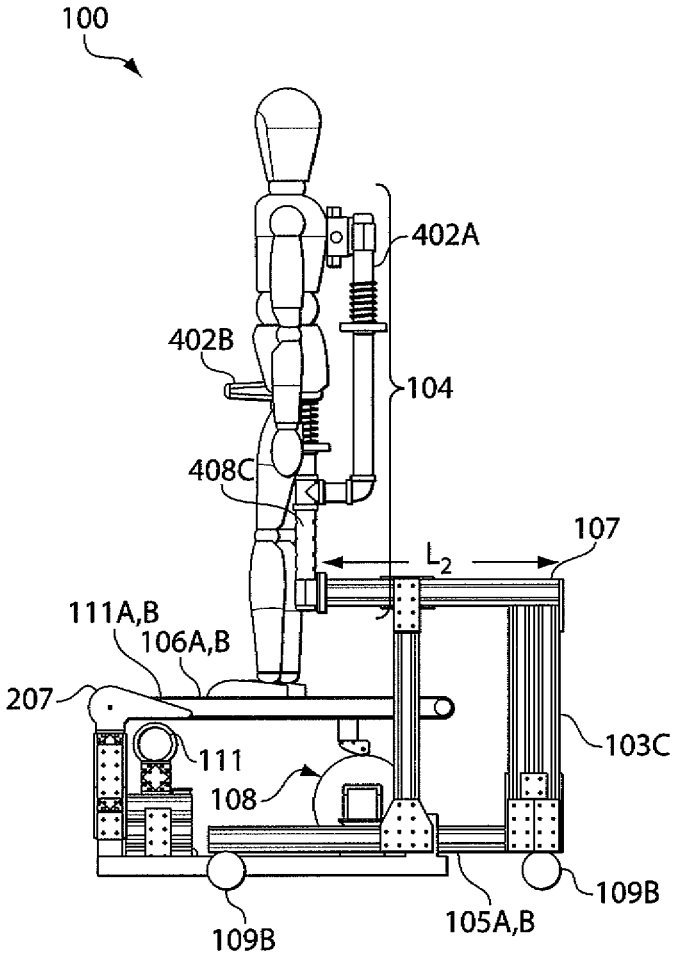
FIG. 1 is a schematic diagram of a side view of an apparatus according to one aspect of the invention supporting a mannequin.
Figure 2:
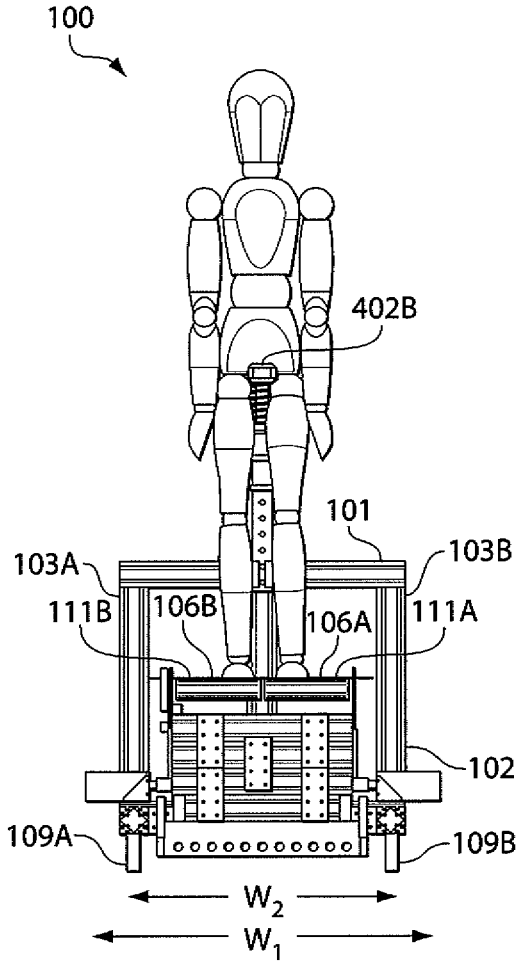
FIG. 2 is a schematic diagram of a front view of the apparatus of FIG. 1.
Figure 3:
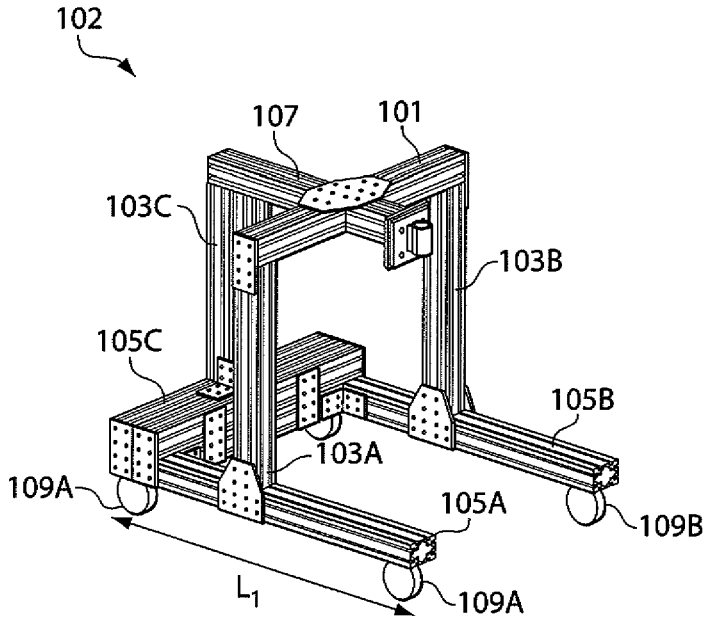
FIG. 3 is a schematic diagram of a perspective view of a frame system of the apparatus of FIGS. 1 and 2.

Referring to FIGS. 1-3, in one aspect, the invention provides a dynamic and interactive lower limb robotic rehabilitation apparatus 100 for supporting and for enabling lower limb movements of a person positioned within the apparatus 100. The apparatus 100 includes a frame system 102 constructed and arranged to integrate and to support a body weight support (BWS) system 104, a walking surface 106, and an actuation system 108 constructed and arranged to actuate the walking surface 106 to reproduce human gait.

As shown in FIGS. 1 and 3, the frame system 102 includes a horizontal member 101 connected at each of its ends to a vertical support member 103A and 103B. The vertical support members 103A and 103B are parallel and each vertical support member 103A and 103B extends vertically downward and connects off-center to a lower base member 105A and 105B, respectively. Each lower base member 105A and 105B extends outwardly from the respective vertical segment 103A and 103B in either direction at an orientation substantially perpendicular to the vertical segments 103A and 103B and the horizontal member 101. A third lower base member 105C connects terminal ends of the lower base members 105A and 105B such that the lower base members define a U-shape. The frame system 102 further includes an upper supporting member 107 cantilevered from a third vertical support member 103C and connected to the horizontal member 101. The third vertical support member 103C extends vertically upward from a substantially central position along the third lower base member 103C. The upper supporting segment 107 is substantially parallel to the lower supporting segments 105A and 105B and is constructed and arranged to connect the frame system 102 to the BWS system 104 and, in particular, to a seat 402B of the BWS system 104, as described below.

The horizontal member 101 may include two cantilevered horizontal segments extending from each of the parallel vertical support members 103A and 103B. In either case, the horizontal member 101 defines a width $W_1$ greater than a width $W_2$ of the split treadmill 106. The frame system 102 thereby adjustably surrounds the split treadmill 106 and positions the split treadmill 106 between the vertical support members 103A and 103B and the lower base members 105A and 105B within the perimeter of the frame system 102. Each lower base member 105A and 105B defines a length $L_1$ sufficient to stabilize the frame system 102. In addition, the cantilevered upper supporting segment 107 defines a length $L_2$ less than the length $L_1$ of the lower base members 105A and 105B to position adjustably the BWS system 104 within the frame system 102 and between the lower base members 105A and 105B.

As shown in FIGS. 1-3, a pair of lockable swivel castors 109A and 109B connects to the front and back ends, respectively, of the lower base members 105A and 105B to permit adjustment of the position of the frame system 102 relative to the BWS system 104 and to help to permit portability and relocation of the apparatus 100. The apparatus 100 and, in particular, the frame system 102 defines a compact footprint to enable the apparatus 100 and frame system 102 to be located in a variety of locations and, in particular, locations with limited floor space. The frame system 102 defines preferably overall dimensions, e.g., not more than 33 inches in width $W_1$ and 80 inches in height, to permit the frame system 102 to fit through a standard-dimensioned door. In one configuration of the frame system 102 according to the invention, the horizontal member 101 is about 29 inches, each vertical support member 103A-C is about 25 inches, each lower base member 105A and 105B is about 40 inches, and the cantilevered upper support member 107 is about 26 inches.

The frame system 102 is constructed and designed to provide a sufficient amount of support graded from zero to full body weight of a subject without unacceptable deflection. The members of the frame system 102 may be constructed of aluminum, e.g., 3-inch square 80/20 extruded aluminum, with connecting plates between members.

The walking surface 106 includes two foot panels 106A and 106B that are constructed and arranged to serve as a foot contact surface and support for a subject's feet where the subject is engaged with the BWS system 104 described below. In addition, each foot panel 106A and 106B is further constructed and arranged to actuate downward from and upward toward a given stationary position, at which a subject's feet rest on and/or are otherwise in contact with the surfaces of the foot panels 106A and 106B. The stationary position may include the foot panels 106A and 106B positioned in a horizontal plane at an orientation substantially parallel to the surface or ground on which the apparatus 10 sits. However, the stationary position of the foot panels 106A and 106B need not be limited to the disclosed orientation and may include other, such as inclined, orientations, relative to the surface or ground. The foot panels 106A and 106B downward movement away from the stationary position allows a subject's leg and foot to swing forward and accelerate (similar to a pendulum), as the panel 106A and 106B lowers away from the subject's foot. The foot panels 106A and 106B upward movement toward the stationary position raises the subject's unsupported leg and foot (after swinging forward) to support the subject's leg, as the panel 106A and 106B returns to the stationary position. Lowering the foot panel 106A and 106B allows a subject's foot resting thereon to move from the stance phase to the toe-off phase of a gait cycle after which the subject's leg and foot propel forward as the swing phase of the gait cycle. Raising the foot panel 106A and 106B contacts the subject's unsupported foot and raises/supports the subject's foot as the panel returns the foot to the stance phase of the gait cycle.

Each foot panel 106A and 106B further includes a conveyor 111A and 111B that conveys or moves a subject's foot backward. During alternate lowering and raising of each foot panel 106A and 106B, the conveyor 111A and 111B moves a subject's foot backward and, more particularly, translates the subject's foot through the stance phase until the foot reaches the toe-off phase of the gait cycle.

Where a subject engages with the body support system 104, the system 104 may support in part or completely the subject's weight and may stabilize the subject's trunk. In this position, the subject's legs are relaxed and their feet rest on the surfaces of the foot panels 106A and 106B. For gait training, one foot panel 106A and 106B lowers behind the subject's foot (heel). Alternatively, one foot panel 106A and 106B lower substantially vertically, e.g., the foot panel does not lower or raise at or from one of its ends, in a downward manner below the subject's foot. Lowering the foot panel 106A and 106B allows gravity and the dynamics of the subject's muscular and skeletal systems to propel the subject's leg forward and to accelerate the subject's foot (heel) towards the surface of the lowered foot panel 106A and 106B. The forward swing of the subject's foot translates the subject's foot from the toe-off phase through the swing phase. At this time, the conveyor 111A and 111B of the other foot panel 106A and 106B moves the subject's other foot backward to translate the subject's other foot from the stance phase to the toe-off phase. As the lowered foot panel 106A and 106B raises and contacts the subject's foot, such as at the end of the foot's swing phase, the subject's heel contacts the raising foot panel 106A and 106B to achieve the heel strike phase. The dynamics of the subject's forward step, including the toe-off and swing phases, and heel strike phase are achieved with the lowering and rising of the foot panels 106A and 106B and without manual or mechanical intervention. The two foot panels 106A and 106B alternately lower and rise, or, in other words, oscillate, to reproduce gait, such that, one foot panel 106A and 106B is lowering behind the subject's heel to allow free leg/foot swing, while the other foot panel 106A and 106B remains parallel to the ground to translate the subject's foot backward.

Figure 4A:
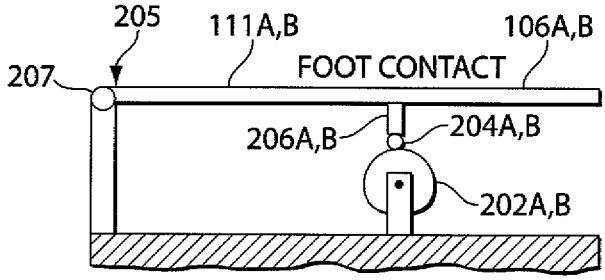
FIGS. 4A and 4B are schematic diagrams of a side view of a two-panel walking surface/treadmill and a portion of a cam system of the apparatus shown in FIGS. 1 and 2 as an example of an actuation system.
Figure 4B:
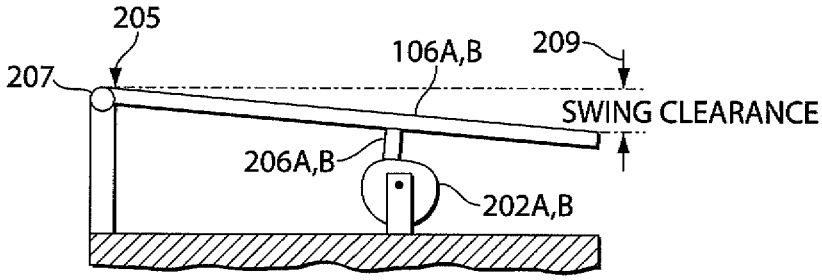
Figure 5:
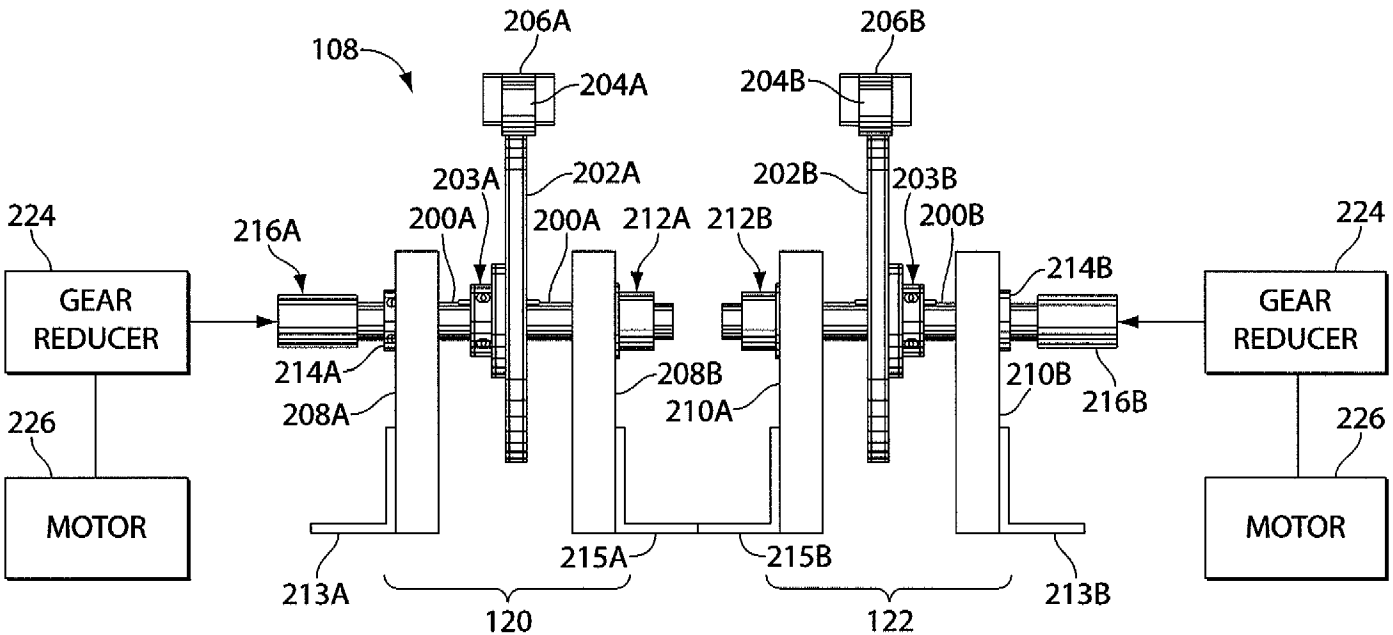
FIG. 5 is a schematic diagram of a perspective front view of the cam system shown in FIGS. 4A and 4B as an example of an actuation system that lowers and raises the walking surface/treadmill panels.

Referring to FIGS. 4A and 4B and FIG. 5, and with further reference to FIGS. 1 and 2, in one embodiment of the apparatus 100 according to the invention, the two-panel walking surface 106 includes a hinged, split two-panel treadmill 106 including a first foot panel/treadmill 106A and a second foot panel/treadmill 106B. In one embodiment of the apparatus 100 according to the invention, the actuation system 108 for actuating the foot panels of the walking surface 106 includes a cam system 108. The cam system 108 is constructed and arranged to actuate each of the foot panels 106A and 106B of the split two-panel treadmill 106 as described below. The invention is not limited in this respect and envisions that the apparatus 100 may include other alternative actuation systems 108 and actuators to control lowering and raising of the foot panels 106A and 106B. Some of the envisioned alternative actuation systems 108 and actuators are described below with reference to FIGS. 13A and 13B.

In one embodiment, the cam system 108 actuates the foot panels 106A and 106B from a stationary position that may include the panels 106A and 106B disposed in a horizontal plane at an orientation substantially parallel to the ground. At the stationary position, the subject's feet are resting on the top surface of the foot panels 106A and 106B and are at the stance phase of a gait cycle. However, the stationary position may include other orientations of the foot panels 106A and 106B, e.g., inclined orientations, relative to the ground or surface on which the apparatus 100 sits. In one embodiment of the invention, and for purposes of disclosing the invention, the stationary position of the foot panels 106A and 106B includes the substantially parallel orientation relative to the ground position from which the foot panels 106A and 106B lower from and raise toward during gait training.

The cam system 108 also actuates the foot panels 106A and 106B to provide adequate swing clearance by lowering each foot panel behind a subject's heel. Further, the cam system 108 actuates the foot panels 106A and 106B to raise and return the foot panels 106A and 106B to the stationary position to enable the heel strike phase of the gait cycle at which a subject's heel strikes the foot panel 106A and 106B when raised.

The apparatus 100 and/or the cam system 108 may be constructed and arranged to control the speed of the cam system 108 and, more particularly, the speed of lowering and raising the foot panels 106A and 106B. The apparatus 100 and/or the cam system 108 may be further configured to control cam speed in order to grade the impedance of contact between a subject's foot and the surfaces of the foot panels 106A and 106B, affording different levels of cushioning to foot impact and simulating from very soft to very hard surfaces. The apparatus 100 and/or the cam system 108 may also be constructed and arranged to propel the subject's legs upwards, such as above a horizontal plane.

As shown in FIG. 5, the cam system 108 includes two cam assemblies 120 and 122. The cam assemblies 120 and 122 are identical with the exception of the orientation of a camshaft 200A and 200B of each cam assembly 120 and 122, as best shown in FIG. 5. Each cam assembly 120 and 122 includes a cam 202A and 202B mounted to a respective camshaft 200A and 200B via a cam mounting flange 203A and 203B in such a manner to permit the camshaft 200A and 200B to rotate each cam 202A and 202B, as described below. Each cam 202A and 202B is positioned equidistant between two bearing blocks 208A, 208B and 210A, 210B via the camshaft 200A and 200B. As shown in FIG. 5, each camshaft 200A and 200B extends through the bearing blocks 208A, 208B and 210A, 210B, such that, a portion of each camshaft 200A and 200B exits from each end of the bearing blocks 208A, 208B and 210A, 210B.

As shown in FIG. 5, one portion of each camshaft 200A and 200B exiting the bearing block 208B and 210B that faces toward the inside of the cam system 108 defines a threaded end portion of the camshaft 200A and 200B and is secured with the bearing block 208B and 210B via a bearing nut 212A and 212B. The position of the bearing nut 212A and 212B along the camshaft 200A and 200B helps to determine the force applied on bearings housed within the bearing blocks 208A, 208B and 210A, 210B during operation of the cam system 108, as described below with reference to FIG. 6. A lock nut (not shown) may be added along the camshaft 200A and 200B adjacent and proximate the bearing nut 212A and 212B to help to prevent the bearing nut 212A and 212B, pre-load, from moving. The bearing nut 212A and 212B is preferably positioned along the camshaft 200A and 200B so that each camshaft 200A and 200B and thereby each cam 202A and 202B are able to spin freely without any substantial lateral motion.

The opposite portion of each camshaft 200A and 200B exiting the bearing block 208A and 210B, which faces toward the outside of the cam system 108, defines a non-threaded end portion of the camshaft 200A and 200B. Each non-threaded portion is secured with the bearing block 208A and 210A via a combination of a shaft collar and a retaining clip 214A and 214B. In addition, the non-threaded portion of each camshaft 200A and 200B connects operatively with a gear reducer 224 and a motor 226 via a coupler 216A and 216B. The cam system 108 may further include a controller (not shown), e.g., a closed-loop controller, operatively coupled with the motors 226 to control actuation of the foot panels 106 and to achieve their oscillating operation. The controller may operate, e.g., automatically and/or programmatically, each motor 226 thereby to control actuation, e.g., cam speeds, of the respective cam assemblies 120 and 122. The controller may be configured and programmed with particular data or instruction sets to achieve a, e.g., predetermined, swing clearance 209, and to coordinate and control cam speeds to adjust treadmill actuation in order the apparatus 100 may be adjusted to meet a range of subjects with varying abilities. As mentioned, the speed of the cam system 108 can be controlled to grade the impedance of the contact between a subject's foot and the treadmill foot panels 106A and 106B, affording different levels of cushioning to impact from very soft to very hard. The speed of the cam system 108 can also be controlled to propel the leg upwards.

Each camshaft 200A and 200B transmits torque from the respective motor to its cam 202A and 202B to actuate or rotate the cam 202A and 202B. Each cam assembly 120 and 122 thereby has its own dedicated gear reducer and motor to actuate independently each camshaft 200A and 200B and cam 202A and 202B, so that each cam assembly 120 and 122 may actuate each of two foot panels 106A and 106B of the split treadmill 106 at a different rate. This provides flexibility to the split treadmill 106 and to the apparatus 100, especially with respect to the apparatus' 100 capacity to accommodate certain subjects, such as stroke victims, with only one side affected or with one side affected more than another side.

In addition, the cam assemblies 120 and 122 and their respective gear reducers and motors are constructed and arranged in order that the cam system 108 may be disposed under the split treadmill 106. The cam assemblies 120 and 122 are also constructed and arranged to permit the gear reducers and motors to be incorporated with the frame system 102, e.g., bolted to one or both of the lower supporting segments 105A and 105B via one or more brackets 213A, B and 214A, B. This helps to define the apparatus 100 according to the invention with a compact footprint and relatively simple maneuverability.

In one configuration of the invention, the cam system 108 includes radial cams 202A and 202B to actuate foot panels 106A and 106B of the treadmill 106 because the cam motion is perpendicular to the camshafts 200A and 200B, and because radial cams are less expensive to manufacture than other designs. As shown in FIGS. 4A and 4B, each cam 202A and 202B is connected to one foot panel 106A and 106B of the split two-panel treadmill 106 and, as shown in FIG. 5, is parallel to and spaced from the other cam 202A and 202B below the treadmill 106.

Still referring to FIGS. 4A and 4B, each cam assembly 120 and 122 includes a roller follower 204A and 204B that is bolted to an underside of one foot panel 106A and 106B via a follower attachment 206A and 206B, e.g., a bolt fastener. Each roller follower 204A and 204B is constructed and arranged to interface with an outer perimeter surface of the cam 202A and 202B, such that, as each camshaft 200A and 200B rotates the cam 202A and 202B during operation of the apparatus 100, the roller follower 204A and 204B rolls along the outer surface of the cam 202A and 202B.

The shape or configuration of the cam's 202A and 202B profile helps to dictate the motion profile of the treadmill 106, while the roller follower 204A and 204B transmits the motion of each cam 202A and 202B to each foot panel 106A and 106B of the treadmill 106. Each foot panel 106A and 106B essentially acts as an oscillating follower. Each panel 106A and 106B may be hinged along one end 205, opposite to the horizontal segment 101 of the frame system 102, to a hinge mechanism 207. The hinge mechanism 207 is constructed and arranged to permit each panel 106A and 106B to pivot and thereby to oscillate as the cam assemblies 120 and 122 facilitate raising and lowering of the foot panels 106A and 106B. Alternatively, the panels 106A and 106B may not be hinged or include the hinge mechanism 207, but, rather, may be lowered and raised via the cam system 108 and/or the cams 202A and 202B in a downward and upward manner below the subject's foot.

The configuration of the cam 202A and 202B also helps to dictate the foot contact height of the foot panels 106A and 106B and the swing clearance 209 each foot panel 106A and 106B defines during operation of the apparatus 100.

As shown in FIGS. 4A and 4B, each cam 202A and 202B has an irregular shape and profile that includes a portion that defines a shorter profile relative to the treadmill 106 where the cams 202A and 202B are disposed below the treadmill 106. During rotation of the cam 202*a* and 202B, the portion of the cam 202A and 202B defining the shorter profile permits the foot panel 106A and 106B to lower providing the appropriate swing clearance 209. The force of gravity acting on foot panel 106A and 106B maintains constant contact between the roller follower 204A and 204B with the surface of the cam 202*a* and 202*b*. The cam profile thereby achieves during its rotation the swing clearance 209 of the lowering panel. As the cam 202A and 202B continues to rotate to complete one revolution, the portion of the cam 202A and 202B defining the relatively higher profile interfaces with the roller follower 204A and 204B. The perimeter surface of the cam 202A and 202B contacts the roller follower and thereby pushes the foot panel 106A and 106B upward to a position parallel to the ground.

The required swing clearance 209 of the treadmill foot panels 106A and 106B determines the size of the cams 202A and 202B in terms of the largest and smallest cam diameters. In addition, the size of the cams 202A and 202B affects the ability to locate the cams 202*a* and 202B below the treadmill 106 and preferably within the frame system 102, e.g., between the lower support segments 105A and 105B. For instance, in one configuration of the apparatus 100 according to the invention, each cam 202A and 202B is about 10.5 inches across at its largest diameter and about 9 inches across at its smallest diameter. This cam sizing permits positioning the cams 202A and 202B below the treadmill 106, which is raised to approximately 12 inches from the frame, and the walking surface, which is raised to approximately 25 inches from the ground. These sized cams 202A and 202B enable the foot panels 106A and 106B to achieve the swing clearance 209 of, for instance, about 1.5 inches (3.8 cm). However, the invention is not limited in this respect, or to the disclosed cam profiles, and envisions other cam profiles that may be suitable or ideal for persons/subjects with different sizes.

The two-panel treadmill 106 is constructed and arranged to deliver gait therapy effectively and safely and to be adjustable to accommodate a range of subjects. For instance, the treadmill 106 in one embodiment of the apparatus 100 according to the invention includes an exercise machine known as the BowFlex TreadClimber® that is marketed for home exercise and was employed in one embodiment of the invention as a base due to its compact footprint. However, alternative hinged, split two-panel treadmills may be used with the apparatus 100 according to the invention including, for instance, two-panel treadmills defining a smaller or larger footprint. The invention is not limited in this respect and anticipates that other configurations and brands of two-panel treadmills may be used. In addition, the invention envisions that other configurations and devices are possible as alternatives to a treadmill to achieve the walking surface 106 with the two panels 106A and 106B as described above.

In one embodiment of the invention, the apparatus 100 and/or the two-panel treadmill 106 are configured and designed with capabilities of controlling speeds of each treadmill foot panel 106A and 106B independently and/or simultaneously. In contrast to a subject pushing the panels of the treadmill downward so that the panels are parallel to the ground, the subject would face the opposite direction when engaged with the treadmill 106 of the apparatus 100, and the foot panels 106A and 106B would actuate upward and downward from a position, e.g., parallel to the ground. The cylinders, display support columns, and handles of a typical treadmill can be removed, if required, to accommodate the change of a subject facing a direction opposite to the position for exercising with this machine. The treadmill display and controls could be relocated to enable a therapist to access such display and controls.

The treadmill 106 is configured to be sufficiently long to allow a subject to complete a normal stride with an allowance for missteps. The width of the treadmill 106 is configured to accommodate stance width. In one configuration of the apparatus 100 according to the invention, the treadmill 106 dimensions are about 60 inches (150 cm) in length and about 25 inches (60 cm) in width. The width of the treadmill 106 is preferably less than about 29.5 inches (75 cm) in order to avoid or minimize instances that would require a therapist to lean forward in order to access a subject's legs. The invention is not limited to the disclosed dimensions of the treadmill 106 and envisions that the treadmill 106 may define overall dimensions to accommodate a particular configuration, design, or application of the apparatus 100 according to the invention.

With further reference to FIGS. 1-2 and FIGS. 4A-4B, the treadmill 106 provides two hinged foot panels 106A and 106B that each serve as a foot contact surface for a subject's foot. Each foot panel 106A and 106B includes a continuous foot conveyor 111A and 111B that is coupled operatively with a treadmill motor 111, e.g., disposed below the treadmill 106 and between the lower supporting segments 105A and 105B of the frame system 102. Prior to rotation of the cams 202A and 202B, both panels 106A and 106B are at the stationary position substantially parallel to the ground to provide a flat walking surface. One revolution of each camshaft 200A and 200B creates a rotation cycle of each cam 202A and 202B, accommodating various phases of a subject's gait including stance phase, toe-off phase, swing phase, and heel strike phase, as described below with reference to FIGS. 10A and 10B and FIGS. 11A-11C. During the stance phase, the foot panels 106A and 106B are continuously in contact with the cam 202A and 202B due to gravitational force. During the swing phase, the lower profile portion of the rotating cam 202A and 202B permits the foot panel 106A and 106B to lower. The rotation cycles of the cams 202A and 202B are set for operation, such that, one foot panel 106A and 106B is positioned to dispose a subject's foot at the stance phase parallel to the ground, while the other foot panel 106A lowers away from the subject's other foot allowing the swing phase. Each cam 202A and 202B completes a rotation cycle when the higher profile portion of the rotation cam 202A and 202B resumes contact with the roller follower 204A and 204B to push the lowered foot panel 106A and 106B upward, such that, it rises and returns to a subject's foot to the stance phase.

Figure 6:
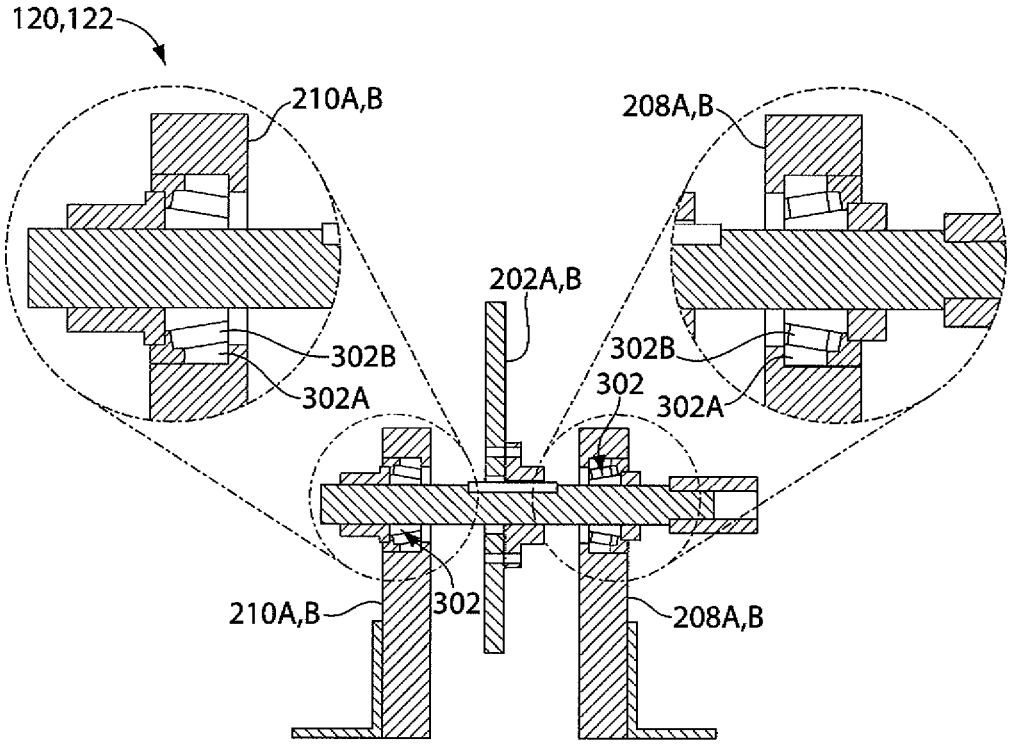
FIG. 6 is a schematic diagram of cross-sectional front view and exploded views of the cam system shown in FIG. 5.

Referring to FIG. 6, and with further reference to FIG. 5, cross-sectional views of the internal configurations of the bearing blocks 208A, 208B and 210A, 210B of one of the cam assemblies 120 and 122 are provided. To minimize the rotary friction of the apparatus 100 and to transmit the torque from the motors to the cams 202*a* and 202B via the camshafts 200A and 200B, each bearing block 208A, 208B and 210A, 210B includes a bearing assembly. The bearing assembly is constructed and arranged for support of radial loads given that the camshaft 200A and 200B load is primarily radial and the camshaft 200A and 200B operates at constant and relatively low speeds. In one configuration of the apparatus 100 according to the invention, tapered roller bearings are preferred because the bearing geometry is capable of supporting heavy axial, radial, and any combination of these two loads, as well as shock loads of subjects stepping on the treadmill 106. In addition, tapered roller bearings rotate without roller skidding, which enables roller portions of the bearings to wear evenly and to prolong bearing life, and tolerate misalignment well.

Each bearing block 208A, 208B and 210A, 210B is machined with an internal press fit, which is configured to receive a cup portion 302A of a tapered roller bearing 302, and with a shoulder 304 configured to prevent axial motion of the cup portion 302A. The cup portion 302A receives a cone portion 302B of the tapered roller bearing 302. In one configuration of the apparatus 100 according to the invention, the bearings 302 are sized to fit with the cam shaft 200A and 200B having about a 1-inch diameter. The collar clamp 204A and 204B along the motor coupling side of each camshaft 200A and 200B and the nut 214A and 214B along the threaded portion of each camshaft 200A and 200B create the pre-load on the pair of tapered roller bearings 302.

Referring to FIGS. 7A and 7B and FIGS. 8 and 9, and with further reference to FIGS. 1 and 2, the body weight support (BWS) system 104 of the apparatus 100 includes a subject interface 402 and a subject harness or vest 404. The interface 402 and the harness or vest 404 are constructed and arranged to position and support subjects that are not able to support their weight on an impaired leg(s), or need assistance in order to maintain balance, during gait therapy. The BWS system 104 of the invention is further constructed and arranged to provide support sufficient to unload up to 100% of a subject's weight and to keep the subject safe from falls, while eliminating or minimizing interference with the subject's required ranges of lower-limb motion. For instance, using a patient weighing 350 lbs (158.8 kg) as an upper limit, and using a factor of safety of 3 for fall prevention, the BWS system 104 can be constructed to withstand up to about 1050 lbs (476.4 kg).

Figure 7A:
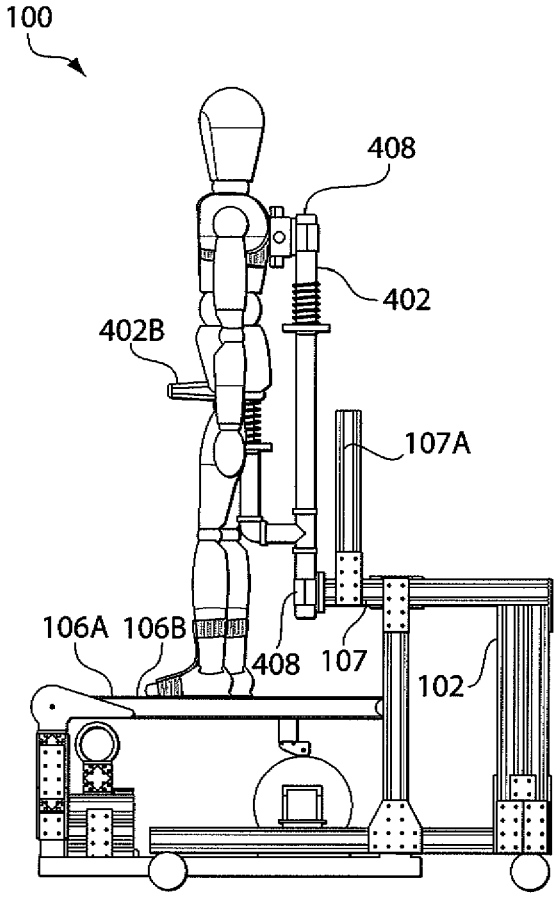
FIGS. 7A and 7B are perspective views of a mannequin positioned via a body weight support (BWS) system of the apparatus shown in FIGS. 1 and 2.
Figure 8:
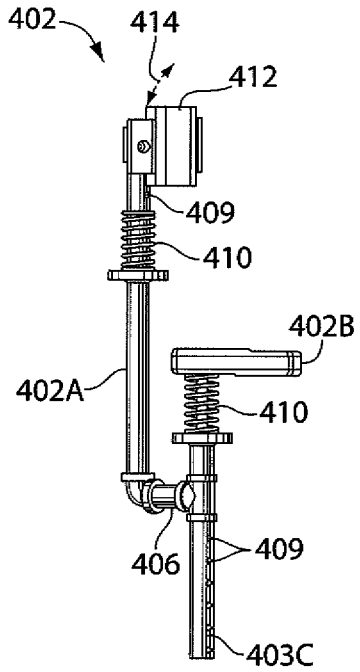
FIG. 8 is a schematic diagram of a perspective view of a subject interface of the BWS system shown in FIGS. 1 and 2 and FIGS. 7A and 7B.
Figure 9:
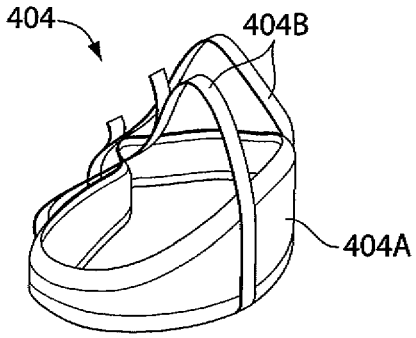
FIG. 9 is a schematic diagram of a perspective view of a subject harness or vest of the BWS system shown in FIGS. 1 and 2 and FIGS. 7A and 7B.

As best shown in FIG. 8, the subject interface 402 includes a vertical back support 402A and a seat or saddle 402B. The vertical back support 402A connects, e.g., via one or more pipe collars, to the cantilevered supporting segment 107 of the frame system 102 and, optionally, to an additional vertical support segment 107A of the frame system 102 shown in FIG. 7A. The vertical back support 402A connects to the subject harness or vest 404 and thereby provides upper body support. The seat or saddle 402B connects to the vertical back support 402B and permits a subject to be supported from below the waist. The subject interface 402 is constructed and arranged to support a subject's trunk without completely restricting the subject's vertical motion, pelvic rotation, and pelvic tilt, while allowing sufficient degrees of freedom to permit the subject to complete a natural gait while positioned in the BWS system 104.

In one configuration of the invention, as shown in FIG. 8, the subject interface 402 includes the vertical back support 402A connected via a cantilevered member 406 to a vertical support 403C for the seat or saddle 402B. The supports 402A and 403C and the cantilevered member 406 may be configured and arranged as nesting pipes. Coupling ends of the nesting pipes are lined with Teflon® sleeves (not shown) to allow a close fit of coupling pipe ends and to reduce sliding friction and wobbling between coupling pipes of the vertical supports 402A and 403C and cantilevered member 406. The invention is not limited in this respect, or to the disclosed configuration and arrangement of the supports 402A and 403C and the member 406 as nesting pipes, and envisions any of various configurations and arrangements of the requisite support 401A or 403C and/or the member 406 to achieve the disclosed support and adjustment capabilities of the apparatus 100.

In one embodiment of the invention, the BWS system 104 and, in particular, the subject interface 402 are constructed and arranged to allow about ±2 inches of vertical support of a subject's center of gravity to help to permit normal gait during treadmill therapy and to help to permit rotation of about ±30 degrees in the frontal plane. In addition, in this embodiment, the BWS system 104 and, in particular, the subject interface 402 are constructed and arranged to allow rotation about the vertical axis of about ±4°. Vertical rotation is important for the swing phase of advancing a subject's foot for the next step.

The heights of both the vertical body support 402A and the seat or saddle 402B are adjustable to help to accommodate the subject interface 402 to a range of subjects. In one embodiment of the invention, quick release pins, e.g., stainless steel pins, may be disposed along the nesting pipes at adjustment points 408, e.g., including one or more holes 409 defined in the nesting pipe of either or both supports 402A and 403C and/or the member 406 with each hole 409 configured to receive at least a portion of a quick release pin. The invention is not limited in this respect, or to the disclosed quick release pins, and envisions alternative mechanisms and devices to permit adjustment of the position of the vertical body support 402A and the seat or saddle 402B. Alternative mechanisms and devices to adjust the height of vertical body support 402A and/or the seat or saddle 402B include, but are not limited to, a lead screw similar to a car jack or a pneumatic cylinder, which includes a scale used to determine the amount of body weight support required ranging from zero (no body weight support) to 100% support of a person's weight.

Both the vertical back support 402A and the seat or saddle 402B employ one or more adjustable springs 410 to allow vertical movement of a subject's body, e.g., adjustable spring rate, and to provide adjustable body weight support for a range of subjects. In addition, the nesting pipes design of the vertical back support 402A and the seat 402B allows vertical motion of a subject's pelvis and back and allows rotation of the subject's body. In particular, the seat 402B permits rotation of a subject's pelvis within a desired range of motion, which is important for training a subject's normal gait. Although not shown in FIG. 8, one or more stops can be incorporated into the body interface 402 to limit and to adjust rotation depending on a subject's abilities.

The vertical back support 402 includes an attachment 412 along the front of the back support 402 constructed and arranged to connect the subject harness or vest 404 to the back support 402. The attachment 412 is further configured to permit a predetermined pelvic tilt in a subject connected to the harness or vest 404. As shown by arrow 414 in FIG. 8, the attachment 412 may be configured to permit a forward tilt within a range of movement, e.g., between about 5° to about 20° and preferably about 5° (which is required on average). Preventing pelvic tilt in a subject would inhibit the subject from realistically practicing and maintaining balance. The range of movement of the attachment 412 can also help to provide flexibility when securing a subject in the harness 404.

Adjustable stops can be integrated with the attachment 412 to reduce the range of movement of the attachment 412 during therapy.

The BWS system 104 may be constructed and arranged with additional degrees of freedom, in addition to allowing vertical motion, pelvic tilt, and rotation about the vertical and frontal axes, such as, for instance, to accomplish lateral motion. The BWS system 104 may be further configured with the objective of achieving a balance between restricting and allowing motion, gait quality, and safety of the impaired subject.

The vertical back support 402, as mentioned, removably connects to the subject harness or vest 404. The vertical back support 402 and the subject harness/vest 404 provide upper body support and trunk stabilization and keep a subject secured to the apparatus 100. In addition, a belt (not shown) serves to secure a subject's waist and to stabilize the subject against the seat 402B. Unlike overhead full-body harnesses that may increase the height of a therapy device, require significant time to attach and remove from a subject, and cause discomfort due to support straps or harness members digging into a subject's skin, the seat/saddle 402B supports a subject from below their waist and the subject harness/vest 404 comfortably couples the upper body of the subject to the vertical back support 402. The harness/vest 404 includes a chest strap 404A that is easily fitted to a range of subjects and attaches across a subject's chest or trunk and around the subject's back, while shoulder straps 404B further position the harness/vest 404 comfortably on the subject's shoulders. The harness 404 is designed such that it does not interfere with a subject's gait and does not rely on one support point. Because up to 100% of a subject's weight is supported by the vertical back support 402 and the seat/saddle 402A, a subject's weight does not pull downward on the harness/vest 404, causing the subject discomfort at the points of contact of the harness/vest 404 with the subject's body.

The vertical back support 402 may be constructed of steel and, preferably, of aluminum to provide a lighter subject interface 402 that is easier for therapists to adjust.

Figure 7B:
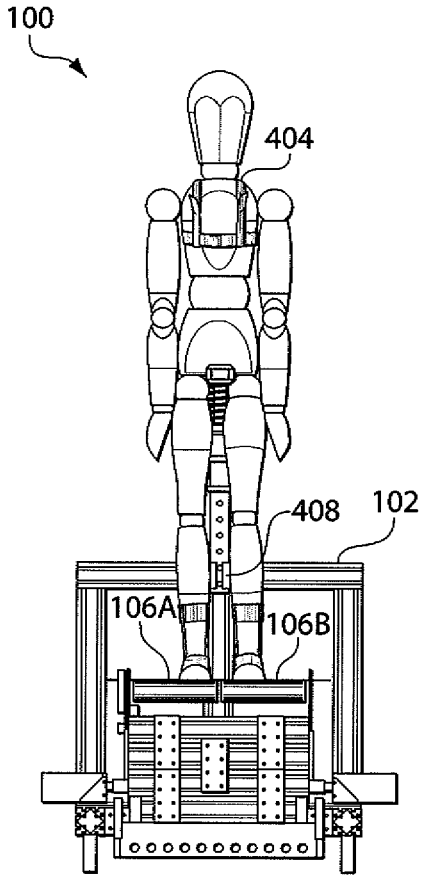
Figure 10A:
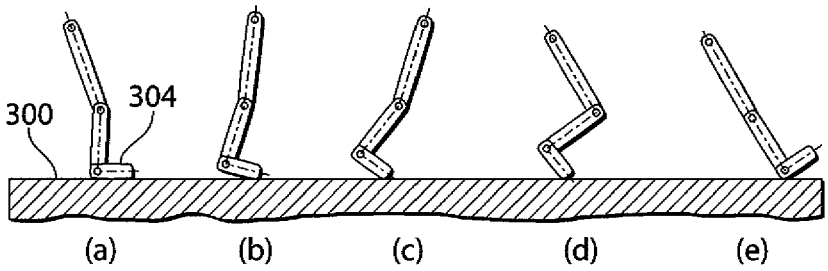
FIGS. 10A and 10B are schematic diagrams of the positions of a subject's foot at the various phase of a human gait cycle.
Figure 10B:
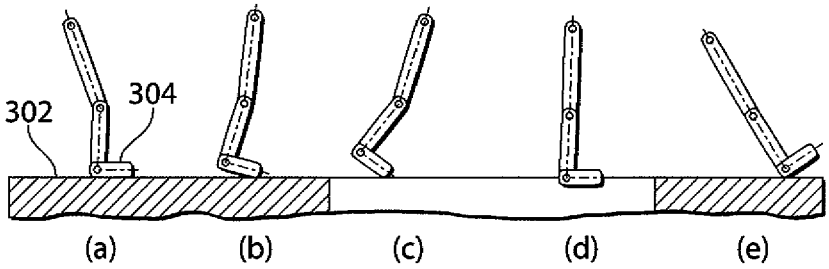

Referring to FIGS. 10A and 10B, and with further reference to FIGS. 7A and 7B, schematic diagrams illustrate phases of human gait that are referred to above and below in describing the invention. FIG. 10A illustrates phases of gait for walking along a substantially flat surface 300, and FIG. 10B illustrates phases of gait for walking along a surface 302 that has the ability to lower, such as the foot panels 106A and 106B of the apparatus 100 according to the invention. The stance phase (or terminal stance phase) (a) of a subject's foot 304 is illustrated in FIGS. 10A and 10B and represents the subject's foot 304 in contact with a substantially flat surface 300, or in contact with the surface 302 having the ability to lower, such as the foot panels 106A and 106B.

The heel-lift phase (b) of FIG. 10A represents a position of a subject's foot as the subject lifts their heel away from the surface 300. The heel-lift phase (b) of FIG. 10B illustrates a position of the heel of a subject, who is supported by the apparatus 100, in response to the surface 302 of one of the foot panels 106A and 106B beginning to lower away from the subject's foot 304.

The toe-off phase (c) of FIG. 10A represents a position of a subject's foot as the subject lifts their foot 304 from the surface 300 with the toe lifting finally from the surface 300. The toe-off phase (c) of FIG. 10B illustrates a position of the subject's foot 304 in response to the surface 302 of one of the foot panels 106A and 106B lowering away from the subject's foot 302.

The swing phase (d) of FIG. 10A represents a position of a subject's foot as the subject begins to swing their foot 304 forward and above the surface 300. The swing phase (d) of FIG. 10B illustrates a position of a subject's unsupported foot 304 where the surface 302 of one of the foot panels 106A and 10B is completely lowered from and not in contact with the subject's foot 304.

The heel strike phase (e) of FIG. 10A represents a position of a subject's foot and heel as the subject first contacts the surface 300 with the heel of their foot 304. The heel strike phase (e) of FIG. 10B illustrates a position of a subject's foot 304 and heel where the surface 302 of one of the foot panels 106A and 106B raises to contact the heel of the subject's foot 304 at the end of the swing phase.

The phases discussed above with reference to FIG. 10B, including stance or terminal stance (a), heel-lift (b), toe-off (c), swing (d), and heel strike (e), are some phases of a full gait cycle and are used above and below to help to disclose the invention and to describe positions of a subject's feet during gait training.

Referring to FIGS. 11A-11C and FIG. 12, and with further reference to FIGS. 1 and 2 and FIGS. 10A-10C, operation of the apparatus 100 according to the invention and, in particular, the foot panels 106A and 106B during therapy are described and illustrated employing a mannequin 500 as the subject and the treadmill as the walking surface 106. While positioned in the subject interface 402 and harness or vest 404 as shown in FIGS. 1 and 2, the subject's (mannequin's) weight is fully supported such that the subject's legs are relaxed and their feet rest on the foot contact surfaces of the treadmill panels 106A and 106B in the terminal stance. As shown in FIGS. 11A-11C and FIG. 12, an ankle brace 412 is secured to each foot of the subject 500 to prevent drop-foot as a result of a relaxed leg and to allow the legs to swing freely as the foot panels 106A and 106B provide the necessary swing clearance for the subject's 500 feet. At this position, the apparatus 100 is capable of training gait to a very passive subject, including a subject that does not have full control of their legs or cannot stand unaided. The apparatus 100 takes advantage of the dynamics of interaction between gravity and skeletal inertia and reproduces gait with the oscillating foot panels 106A and 106B of the treadmill 106.

Figure 12:
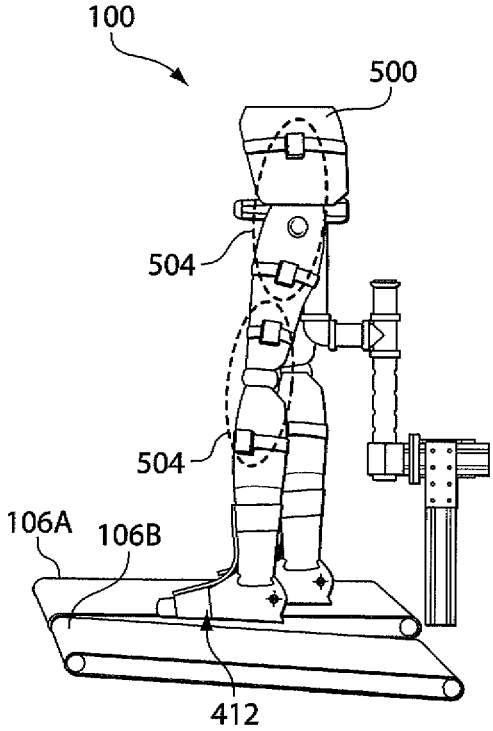
FIG. 12 is a perspective side view of the lower limbs of the mannequin shown in FIGS. 11A-11C, indicating areas at which measurements may be obtained.

FIG. 12 shows areas 504 of the mannequin's 500 legs where goniometers (sensors) were used to record data using a data logging system, including measurements of hip and knee positions during foot panel 106A and 106B actuation. Alternatively, as described below with reference to FIGS. 16A-16C, markers can be placed at the subject's 500 ankle, knee or other portion of his/her leg, and a camera system can be employed to determine the marker positions and thereby the leg positions. The information the camera system captures can be used to determine when to lower or raise the foot panels 106A and 106B.

Figure 11A:
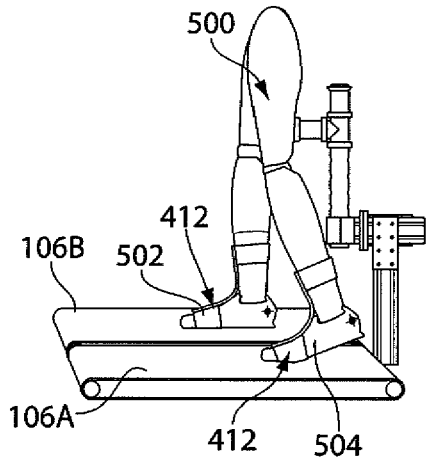
FIGS. 11A-11C are perspective side views of the lower limbs of a mannequin positioned in the apparatus shown in FIGS. 1 and 2 and FIGS. 7A and 7B.
Figure 11B:
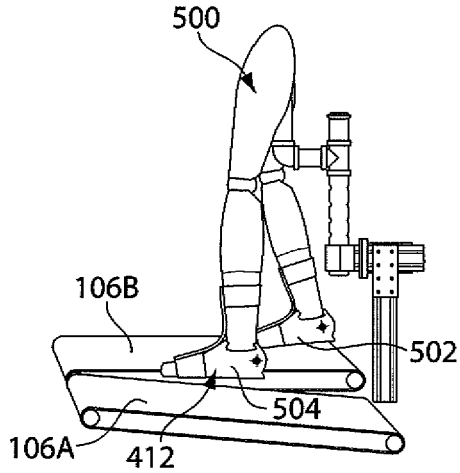
Figure 11C:
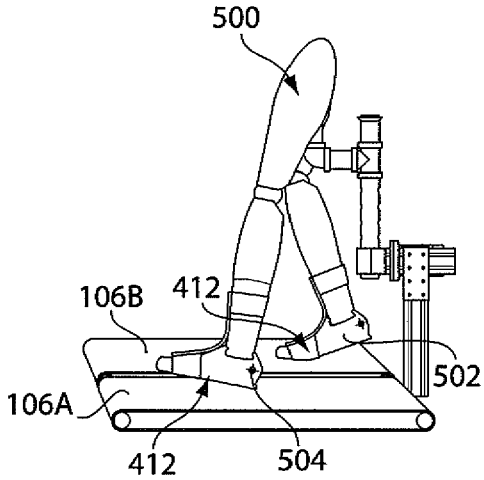

FIG. 11A shows the subject's 500 left foot 504 at substantially the toe-off phase, while FIG. 11B shows the left foot 504 at substantially the swing phase, and FIG. 11C shows the left foot 504 at substantially the heel strike phase as the foot panel 106A and 106B raises the subject's foot to the stance or terminal stance and returns to the stationary position substantially parallel to the ground. Foot contact with the moving conveyors 111A and 111B of the foot panels 106A and 106B translates the foot through the stance phase until the foot reaches substantially the toe-off phase. The apparatus 100 enables a subject to achieve an ecological gait by exploiting natural gravitational, muscular, and skeletal dynamics, while accomplishing toe-off, foot swing, hip extension, and heel strike, and to receive neural input at appropriate muscles as the result of at least the collision between the subject's foot/heel and the foot panels 106A and 106B at heel strike.

Actuation of the foot panel 106A and 106B causes the end of the foot panel 106A and 106B, which is not connected to the hinge mechanism 207, to lower. Alternatively, the foot panel 106A and 106B may lower substantially vertically beneath the foot. This facilitates forward propulsion of the subject's 500 leg in response to gravity. The forward-swinging foot 502 and 504 clears the foot panel 106A and 106B because of the swing clearance 209 the lowered foot panel 106A and 106B provides.

The speeds of the conveyors 111A and 111B on the foot panels 106A and 106B may be adjusted in conjunction with the rotational speeds of cams 202A and 202B to vary the gait speeds and to challenge the subject to increase his/her contribution to the motion based on the subject's performance. In addition, conveyor speeds might be controlled, such that, conveyors 111A and 111B operate as the same or different speeds. Conveyor speeds might be altered according to any of various gait performance indices to help to facilitate performance-based gait therapy, as described below, as well as to help to optimize gait training and recovery.

Further, adjusting the conveyor 111A and 111B speeds has been used to help to maximize the symmetry during the swing and stance phases of gait. And, as mentioned, controlling the speeds of the cam system 108 helps to afford different contact impedance between the subject's foot and the treadmill foot panels 106A and 106B that provides different levels of cushioning to foot impact from very soft to very hard. In addition, controlling the speeds of the cam system 108 may provide further control of the neural input.

A group of healthy subjects was tested with the apparatus 100 according to the invention using the apparatus 100 both as a normal treadmill without treadmill 106 actuation and without use of the BWS system 104, and as an actuated treadmill 106 using the cam system 108 and the BWS system 104, as described above. Electromyography from leg muscles was collected via electrodes to measure muscle activation using a 16-channel surface electrode Myomonitor IV wireless data logger available from Delsys of Boston, Mass.

Electromyography (EMG) records electrical signals measured when a muscle contracts. Muscles conduct electrical potentials and the resulting signals from the motor fibers that fire are called motor unit action potentials, or m.u.a.p. Electrodes can record the sum of the m.u.a.p. along a muscle where electrodes are placed on the skin over the muscle surface, or are implanted in the muscle.

Surface EMG was recorded from the subjects during normal (non-actuated) treadmill walking and when subjects relaxed their legs with an ankle brace 412 and the treadmill foot panels 106A and 106B were actuated to provide the necessary swing clearance. EMG signals were recorded from a group of muscles, including the tibialis anterior, the soleus, the rectus femoris, and the semitendinosus of the hamstrings.

The tibialis anterior (TA) muscle is located on the front of the lower part of the leg, anterior or in front of the tibia. For healthy subjects, this muscle exhibits peak EMG activity at heel strike when the foot is dorsiflexed, and little or no activity during mid-stance and toe-off. When the muscle is paralyzed, the subject cannot hold their foot up and the foot exhibits a clinical condition referred to as "drop foot."

The soleus (SO) is located on the lower leg and is activated during foot plantar flexion. McGowan et al. found that the soleus is the primary contributor to forward propulsion while also contributing to body support. This muscle in healthy subjects exhibits peak EMG activity at about the heel off phase.

The rectus femoris (RF) is one of four muscles that make up the quadriceps femoris and is located at the front of the thigh. The rectus femoris is close to the surface of the body and covers most of the other three quadriceps muscles. The rectus femoris exhibits the highest activation at heel strike and a biphasic pattern, meaning it has two activation peaks during one gait cycle.

The hamstrings include three muscles, the semitendinosus, semimembranosus, and the biceps femoris. The semitendinosus (ST) is located along the back of the leg above the knee, is activated during stance phase, and exhibits a triphasic pattern with three peaks. The first peak occurs at heel strike, the second peak at about 50% of the gait cycle, and the third peak at about 90% of the gait cycle.

EMG activity recorded during treadmill actuation using the BWS system 104 indicates that the EMG signals of the TA are very similar to normal treadmill walking with peak activation observed at the heel strike phase and activation throughout the stance phase. EMG signals of the SO and RF show almost no activity during the free swing, but when the subjects and the treadmill actuation are not coordinated, EMG signals resembled normal treadmill walking. Because the SO is responsible for forward propulsion, it is logical that its activity decreases greatly when gravity and treadmill actuation facilitate the swing phase. EMG signals measured from the ST look very similar to the normal treadmill walking with a triphasic pattern because the ST activates during weight bearing, even though the BWS system 104 is employed. These EMG measurements show that even during free swing, the TA and the ST are activated, while the SO and RF are not, and the leg experiences loading and generates EMG signals. The testing results indicate that the apparatus 100 according to the invention can be employed in a completely passive state and further indicate that candidates for gait therapy employing the apparatus 100 do not need to have full control of their legs before beginning therapy.

Figure 13A:
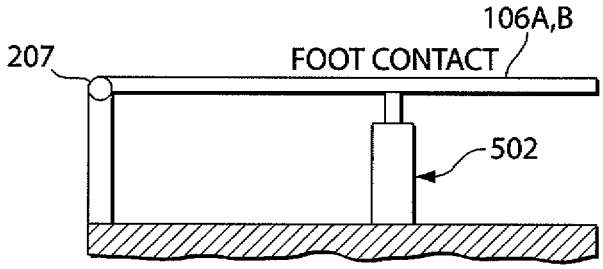
FIGS. 13A and 13B are schematic diagrams of side views of a two-panel walking surface/treadmill and alternative actuation systems or mechanisms to lower or raise the panels shown in FIGS. 1 and 2 and FIGS. 7A and 7B.
Figure 13B:
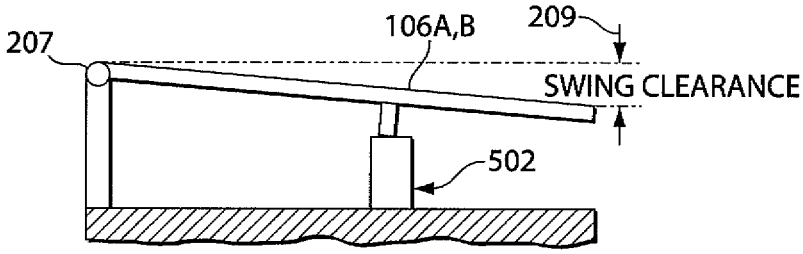

Referring to FIGS. 13A and 13B, in another aspect, the invention provides the apparatus 100 constructed and arranged as shown and described above with reference to FIGS. 1-3, 7A-7B, 8-9, and 11A-11C and 12. However, the apparatus 100 includes any of various actuation systems, mechanisms, or devices, as alternatives to the cam system 108 and/or the cams 202A and 202B described above. Such actuation systems, mechanisms or devices are constructed and arranged to lower and to raise the foot panels 106A and 106B of the walking surface/treadmill 106, as described above. Such alternative actuation systems and devices may include, but are not limited to, hydraulic, pneumatic, lead screw, jackscrew, slider, and other actuator systems and mechanisms suitable for such purposes. Regardless of the type of actuator system or mechanism 108 employed to actuate the foot panels 106A and 106B, the operating principles of the apparatus 100 according to the invention are the same.

For instance, in one embodiment of the apparatus 100 according to the invention, the system or mechanism 108 that serves as an alternative to the cam system 108 includes one or more alternative actuators to actuate and to control the foot panels 106A and 106B as described above. Each alternative actuator 502 may contact and/or connect to, as the actuator 502 requires, the surface underneath each foot panel 106A and 106B. Each alternative actuator 502 is constructed and arranged to lower and to raise the foot panel 106A and 106B to achieve the required foot clearance. In one embodiment of the invention, the actuators 502 may be operatively couple with a controller, such as the controller described below with reference to FIG. 14. Actuation of the actuators 502 thereby may be accomplished through the controller and/or may be altered through the controller in response to, for instance, any data input signals and/or any of various gait performance indices that the controller processes and responds to in terms of altering and controlling the actuation system 108 and/or the actuators 502.

In one embodiment of the invention, the alternative actuators 502 include hydraulic actuators of a hydraulic system that would include a reservoir to hold the required volume of hydraulic fluid, and at least one pump to supply fluid into each of the two actuators 502. The hydraulic system may further include an accumulator tank to prevent large changes in fluid pressure, and valves that are either manually or electrically controlled that open and close to direct fluid flow, and piping and/or tubing with fittings to operatively connect these components. The hydraulic system 108 components and the actuators 502 may be mounted below and under the walking surface/treadmill 106 to maintain the compact footprint of the frame system 102 and the apparatus 100.

In one configuration of the hydraulic system, the hydraulic actuators include bi-directional hydraulic actuators that are constructed and arranged with two ports and an internal piston configured to push in either direction depending on the port to which the pump supplies fluid. To size correctly the valves and pumps employed with the hydraulic system, the power requirements for the bi-directional hydraulic actuators are determined, which includes considering the volume of fluid to be displaced, and the volumetric flow rate.

The hydraulic system 108, or other alternative system or mechanism 108, may further include a controller (not shown), e.g., a closed-loop controller, coupled operatively with the system or mechanism 108 and/or with the alternative actuators 502. The controller may include configuration and programming to actuate, e.g., automatically and/or programmatically, each alternative actuator 502, such that, the actuator 502 lowers and raises the foot panels 106A and 106B. The controller may be further configured and programmed with data and/or instruction sets that help to achieve a predetermined swing clearance 209, and help to coordinate and control speeds of the alternative actuator 502, such that, lowering and raising of the foot panels 106A and 106B may be adjusted and controlled. Operation of the apparatus 100 thereby may be adjusted and/or modified to meet a range of subjects with varying abilities.

Figure 14:
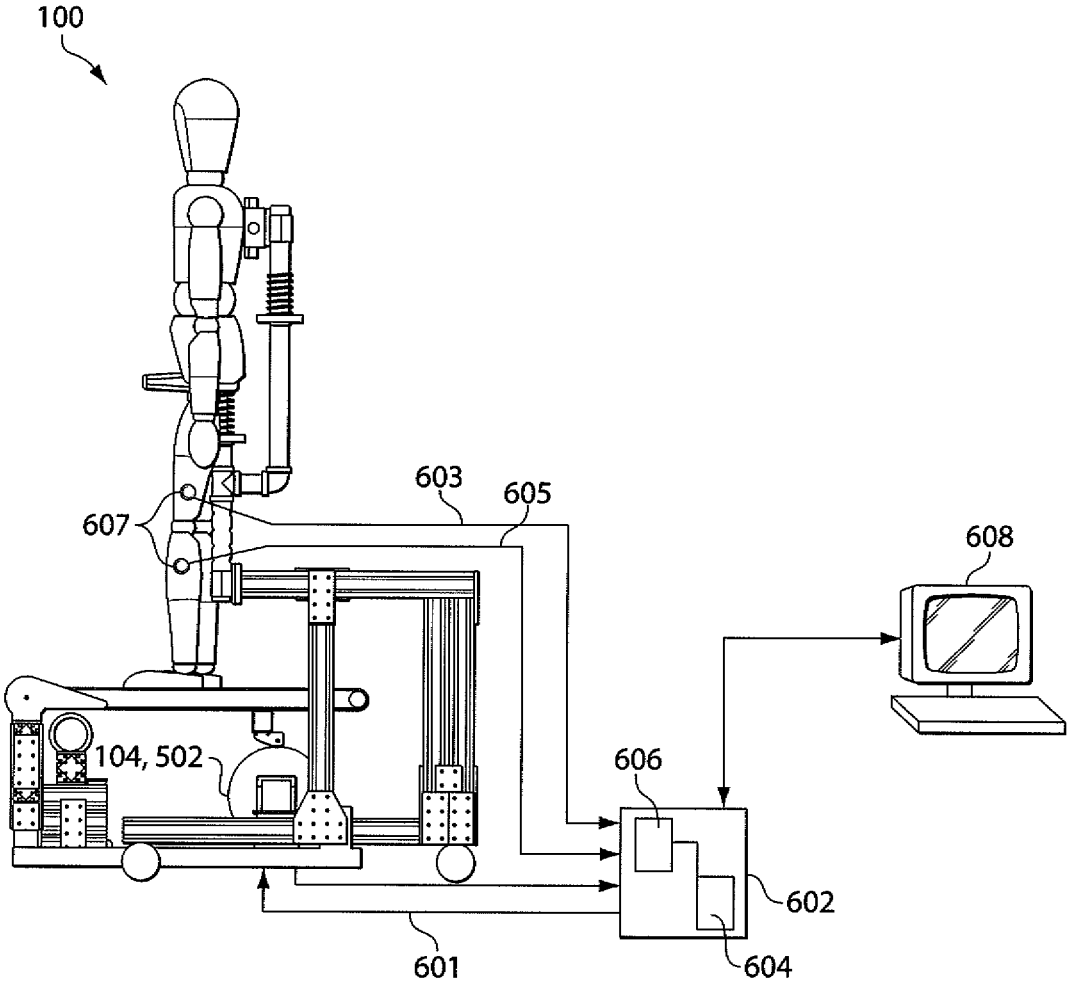
FIG. 14 is a schematic diagram of the apparatus shown in FIGS. 1 and 2 and FIGS. 7A and 7B coupled operatively with one or more sensors, a controller, and a computer.

Referring to FIG. 14, in a further aspect, the invention provides the apparatus 100 constructed and arranged as shown and described with reference to FIGS. 1-3, 7A-7B, 8-9, 11A-11C, and 12. However, the apparatus 100 is configured and designed to couple operatively to a controller 602, e.g., a closed-loop controller. The controller 602 may include a processor 604 coupled with memory 606. The controller 602 may also include configuration and programming to automate partially and/or wholly any of the processes that the apparatus 100 executes and carries out during gait therapy. As mentioned, the motors 226 of the cam system 108, or the alternative actuation system 108 and/or the alternative actuators 502 may couple operatively with the controller 602 for full or partial adjustment and control.

The controller 602 may include configuration and programming to determine, measure, adjust, coordinate, control and record various processes of the apparatus 100, the actuation system 108, the walking surface/treadmill 106, the foot panels 106A and 106B, and/or any of the components related to these systems. Memory 606 may include data and instruction sets that the processor 604 implements to determine, measure, adjust, coordinate, control and record the various processes.

In one embodiment of the invention, the controller 602 and the apparatus 100 are configured, such that, the controller 602 implements, adjusts, coordinates, controls, and/or records various operational processes of the apparatus 100 based on one or more gait performance indices that the controller 602 processes. Such performance indices may include data input signals received from the apparatus 100, any of its systems and components, and/or one or more sensors associated with the apparatus 100 and/or its systems and components. The controller 602 also may be configured to implement, adjust, coordinate, control, and record various operational processes of the apparatus 100, such as, for instance, adjustment and/or control of conveyor 111A and 111B speeds, in relation to performance-based schemes.

For instance, one or more EMG surface sensors 607, or other EMG sensors or goniometers (not shown), may couple operatively with the controller 602, such that, the controller 602 receives data input signals 603 and 605 from the sensors 607 related to EMG activation of a particular group of muscles. The controller 602 may receive such input signals 603 and 605 for further processing, compilation and/or storage, and for adjusting and/or controlling any of the processes that the apparatus 100, the actuation system 108, and/or the foot panels 106A and 106B carry out and/or are involved with during gait therapy. Additionally, or alternatively, the controller 602 may couple operatively with the wireless data logger described above for recording and receiving EMG signals from the one or more sensors 607.

The controller 602 may employ the data input signals 603 and 605 received from the EMG sensors 607 to adjust, change, and/or control, either independently or simultaneously, the speeds of the conveyors 111A and 111B of the foot panels 106A and 106B. The controller 602 may generate and transmit to the cam motors 226 of the cam system 108, or to the alternative actuators 502, and/or other components of the alternative actuation system 108, output adjustment and control signals 601 that may adjust, change and control the conveyor 111A and 111B speeds. The controller 602 thereby may adjust and/or control the conveyor 111A and 111B speeds relative to the measured EMG activity of the particular group of muscles.

In addition, the controller 602 may adjust and/or control the conveyor 111A and 111B speeds with or without data input signals from the EMG or other sensors coupled operatively with the controller 602. The controller 602 may adjust and/or control the conveyors 111A and 111B to operate at the same or distinct speeds, and may adjust and/or control the speeds of either or both conveyors 111A and 111B, independently or not.

Such adjustment and control are particularly advantageous during gait therapy, where the controller 602 generates output signals 601 to adjust and/or control conveyor 111A and 111B speeds in relation to, for instance, measured EMG data that the input signals 603 and 605 represent. EMG data may be used to replicate gait kinematics during therapy sessions through the adjustment and control of the conveyors 111A and 111B speeds that the controller 602 provides. The controller 602 can also generate output signals 601 to adjust and/or control conveyor 111A and 111B speeds in relation to other performance-based schemes, for instance, that modulate speed of the conveyors 111A and 111B based on the symmetry of the step length, or the symmetry of swing duration, or the ability of the patient to keep in pace with the conveyor speed, or a combination of multiple indices.

The apparatus 100 and the controller 602 thereby may adjust and/or control the conveyors 111A and 111B to operate at the same or different speeds during a single therapy session or over the course of successive therapy sessions based on different performance-based schemes[3]. For instance, when a subject demonstrates an ability to accommodate greater or increasing conveyor speeds during a single therapy session or over successive sessions, the conveyor 111A and 111B speeds may be adjusted to and controlled at higher speeds, and in real-time during therapy sessions, in order to present increasing therapeutic challenges to the subject. In another instance, when a subject has a greater impairment in one leg/foot than the other, the controller 602 may accordingly adjust and control independently the speeds of each conveyor 111A and 111B to accommodate the abilities of each leg/foot of the subject and to present appropriate therapeutic challenges (speeds) to each leg/foot. In a further instance, the speeds of the conveyors 111A and 111B may be adjusted and controlled by the controller 602 to help to maximize the symmetry between the step length and the swing duration of a subject's gait during therapy in order to optimize gait training and to enhance or accelerate recovery. The ability to track a subject's/patient's abilities and to challenge them according to a performance-based scheme is a critical component of best therapy practices to enhance recovery.

[3] Krebs, H. I., Palazzolo, J. J., Dipietro, L., Ferraro, M., Krol, J., Rannekleiv, K., Volpe, B. T., Hogan, N., Rehabilitation Robotics: Performance-based Progressive Robot Assisted Therapy, Autonomous Robots, Kluwer Academics 15:7-20(2003).

With such adjustment and control, the controller 602 may also facilitate a different kinematic pattern in each leg/foot to accommodate the particular abilities of the leg/foot, and/or to ensure activation of appropriate muscle groups and thereby necessary neural input relative to the leg/foot's impairment. As mentioned, the objective of the apparatus 100 and method according to the invention is to permit and to enable a subject to engage physically as much as possible in self-generated leg/foot propulsion that the apparatus 100 allows during gait training.

In addition to adjustment and control of the speeds of the foot panel 106A and 106B conveyors 111A and 111B, the controller 602 may similarly adjust and control the speeds and frequency of actuation, lowering and raising, of the foot panels 106A and 106B. The controller 602 can generate such adjustment and control output signals 601, such that, the foot panels 106A and 106B change and maintain the rate and frequency of lowering and raising in coordination with the increases and decreases in speeds of the foot panel conveyors 111A and 111B.

Further, the controller 602 may adjust and control lowering and raising of the foot panels 106A and 106B with different values of impedance to provide different levels of impact to a subject's foot along the foot panel 106A and 106B surface and to simulate from very soft to very hard surfaces.

Data that the EMG input signals 603 and 605, or other sensor input signals, represent may be received and stored in the controller 602 memory, and/or may be transmitted to a computer or other data processing device 608 disposed locally or remotely relative to the apparatus 100 for further processing, compilation, and/or storage. In this manner, the controller 602 may monitor in detail and may confirm via measured EMG data, or other data, a subject's individual progress. The gait therapy that the apparatus 100 delivers to the subject may be reinforced and/or adjusted accordingly to ensure and to confirm that subject's muscle groups are receiving necessary neural input and the subject is reacquiring normal gross movements and leg coordination.

In addition, data compilation and storage the controller 602 and/or the computer or processing device 608 achieve would provide an automatic recapitulation of one or more therapy sessions. The controller 602 and/or the computer 608 may use such data to repeat or to adjust specifications of therapy sessions and particular kinematic patterns for the same or different subjects. Data compilation from therapy sessions of multiple subjects may provide data useful in formulating therapy specifications and kinematic patterns for different subjects with similar gait impairment. Further, an operator may employ the computer or data processing device 608 locally or remotely to implement, adjust, monitor and control specifications of therapy sessions or kinematic guidelines or patterns through the controller 602. Alternatively, the apparatus 100 may implement such therapy specifications and kinematics through an operator's manual setting and adjustment of the controls and the components of the apparatus 100 during gait therapy.

Additionally, or alternatively, the controller 602 may receive input signals (not shown) from other sensors or devices (not shown) configured and designed for use with brain scanning technology, including, for instance, electroencephalography (EEG) or near infrared spectroscopy (NIRS). The input signals such sensors/devices transmit to the controller 602 would provide data representing brain activities that relate or correspond to, for instance, interpreted neural inputs to muscle groups that a subject's musculoskeletal activities generate during the subject's gait therapy with the apparatus 100. Such data input signals produced from brain scanning technology may help to formulate gait therapy specifications and specific kinematic guidelines or patterns for an individual subject and/or a given set of subjects, which the controller 602 may implement.

The controller 602 may control the processes of the apparatus 100 in accordance with data it receives from the input signals that EMG, EEG and/or NIRS sensors/devices transmit to the controller 602. In addition, the controller 602 may control the apparatus 100 processes in accordance with data it receives from input signals that other sensors or devices transmit to the controller 602 that monitor and/or measure other values or aspects of a subject's gait performance during gait training. The processes of the apparatus 100 that the controller 602 determines, measures, adjusts, coordinates, controls and/or records, and the data the controller 602 receives, also can form the bases for performance-based gait therapy, as described above with reference to FIG. 14 and below with reference to FIG. 17, that is designed for specific subjects and/or for particular types and degrees of gait impairment.

Other sensors or devices may include, for example, the cameras described below with reference to FIGS. 16A-16C that are disposed relative to the foot panels 106A and 106B and to a subject's foot and leg. The cameras may capture images/photos of a marker located on the subject's ankle, knee or other area along the leg to monitor and measure movement and performance of the subject's gait in order to provide feedback adjustment and control, for instance, activating foot panels 106A and 106B to lower and raise.

Figure 15:
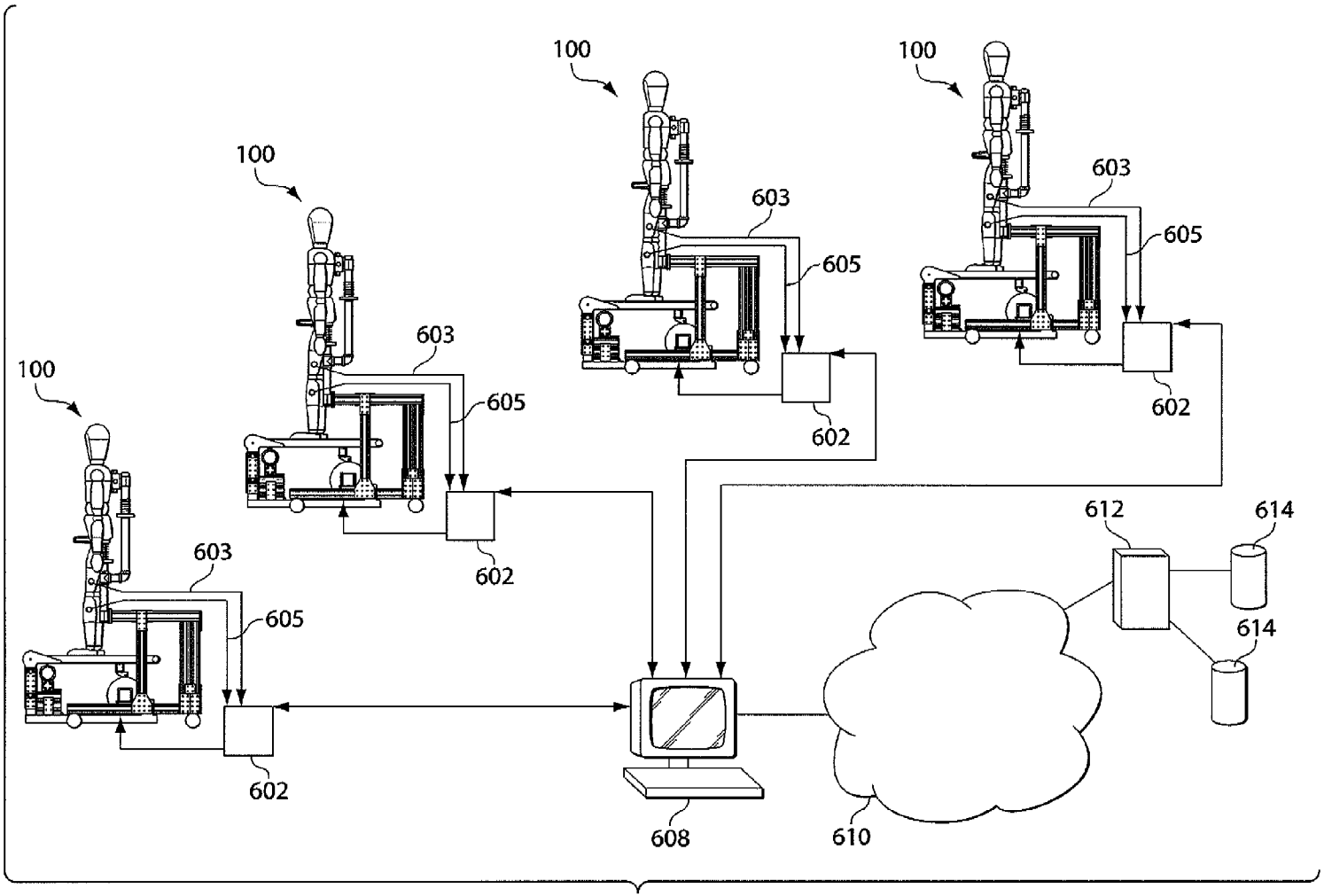
FIG. 15 is a schematic diagram of multiple apparatuses shown in FIGS. 1 and 2 and FIGS. 7A and 7B coupled operatively to one or more computers via a network.

Referring to FIG. 15, one or more local or remote computers 608 may couple operatively to a multiple of apparatuses 100 through its respective controller 602. The computers 608 thereby may coordinate, adjust, and control individually the operation of each apparatus 100 and may receive data input signals 603 and 605 from each apparatus 100 and/or from one or more associated sensors, such as EMG sensors described above. Each apparatus 100 may be located at a single therapy site, or at different locations within the same therapy site, or may be located at geographically separate therapy sites. The one or more computers 608 may include configuration and programming to interconnect operatively through a network 610, e.g., an intranet, the Internet or other wireless network, with a mainframe computer or server 612 that interconnects operatively with one or more data storage devices 614.

Figure 16A:
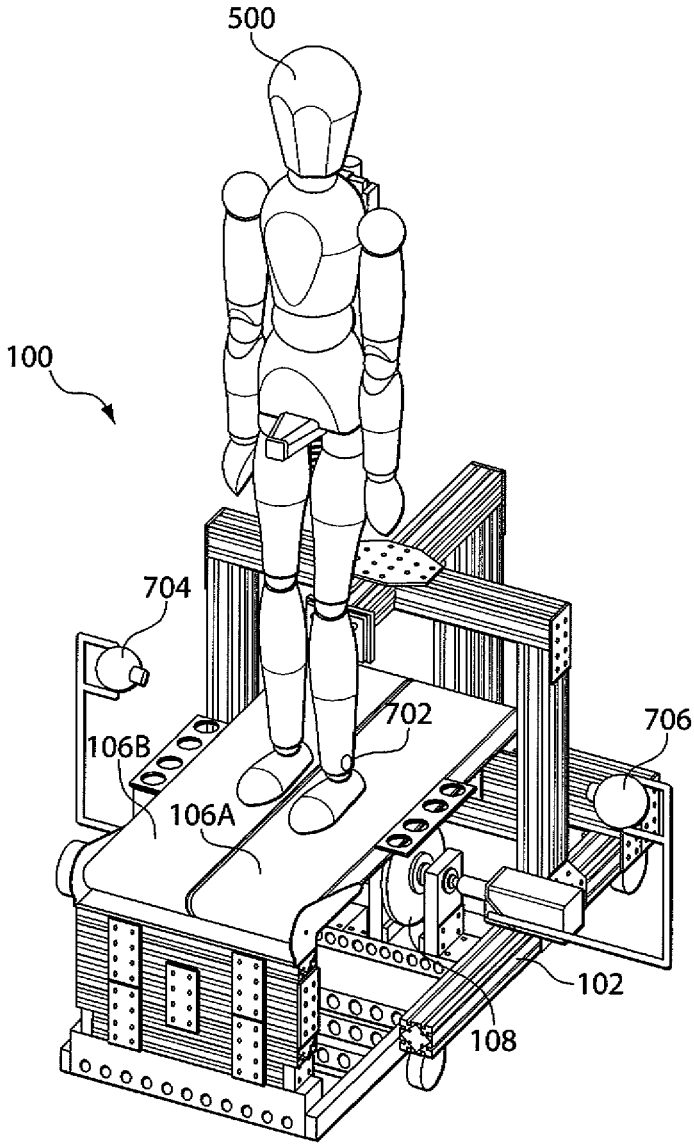
Figure 16C:
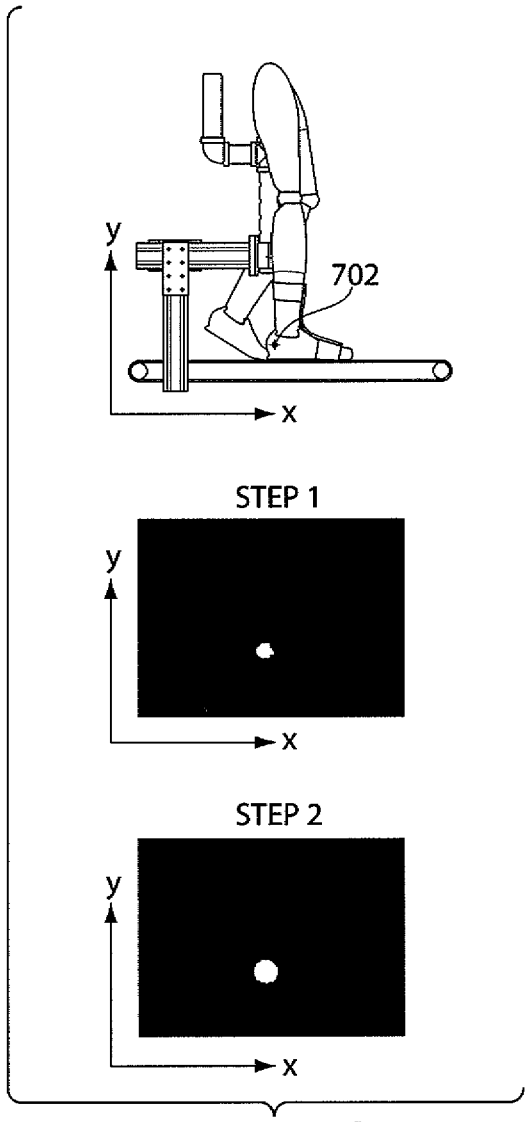

Referring to FIGS. 16A-16C, in one embodiment of the apparatus 100 according to the invention, the apparatus 100 includes or incorporates one or more cameras 704 and 706 that track and record the positions of a marker 702 disposed on a subject's (person's or mannequin's) 500 heel, knee, or other area of their leg. Tracking and recording positions of the marker 702, particularly during gait therapy, may provide information useful in determining when to lower and raise the foot panels 106A and 106B and in determining when to increase/decrease conveyor speeds 111A and 111B of the foot panels 106A and 106B.

As shown in FIG. 16A, in one embodiment of the apparatus 100 according to the invention, one or more cameras 704 and 706 are incorporated with the apparatus 100, e.g., mounted to one or more components of the frame system 102. The one or more cameras 704 and 706 are located at positions relative to the walking surface/treadmill foot panels 106A and 106B in order to capture or photograph the positions of a marker 702 during multiple gait cycles. For instance, a first marker 702 attaches to the heel of the subject's left foot and a first camera 706, positioned relative to the marker 702, may capture/photograph, e.g., continuously, the marker 702 at various positions/phases of multiple gait cycles as the apparatus 100 engages the left foot in gait therapy. Additionally, or alternatively, a second marker (not shown) attaches to the heel of the subject's right foot and a second camera 704, positioned relative to the marker 702, may capture/photograph, e.g., continuously, the marker 702 at various positions/phases of multiple gait cycles.

FIG. 16B illustrates a representative set of camera photo frames the cameras 704 and 706 may capture, while the apparatus 100 delivers gait therapy to the subject 500. The set of photo frames, numbered 1 thru 6, illustrates the tracking and recording of the marker 702 and the various locations of the mannequin's or subject's heel through a full gait cycle. The gait phases represented include the toe-off phase (numbered 1), the mid-swing phase (numbered 2), the heel strike phase (numbered 3), the mid-stance (numbered 4), the terminal stance (numbered 5), and the heel-lift phase (numbered 6). The treadmill foot panel 106A and 106B is at the lowered position during the swing phase (numbered 2), and raises in sufficient time to facilitate an ecological heel strike (numbered 3). The images the cameras 702 and 704 capture provide information that helps to determine when a foot panel 106A and 106B should lower and when the foot panel 106A and 106B should raise. More particularly, the camera images indicate when the subject's leg is backwards at the end of the stance phase and is ready for toe-off and when the subject's leg is forward at the completion of the swing phase and ready for landing. In addition, the images the cameras 702 and 704 capture provide information that helps to determine the subject's gait speed and foot swing velocity.

The marker 702 includes a brilliant color, such as, for instance, the color red. Multiple images that the cameras 704 and 706 capture for multiple gait cycles are entered into a controller and/or data processor, such as the controller 602 and/or data processor 608 described above with reference to FIG. 14, for processing. FIG. 17C illustrates results of processing the multiple images of the marker 702 and thereby the multiple positions of a subject's heel during gait cycles. The images identified as step 1 and step 2 represent successive stages of processing of the marker 702 positions. The white image regions shown represent processed camera frames and include selected pixels, ranging from shades of pink to red, which correspond to positions of the marker 702 during gait cycles. The processed information may be used to determine with relative accuracy when the foot panels 106A and 106B should lower and raise for a particular subject, such that, the musculo-skeletal dynamics of the subject's limbs during therapy may be optimized and the neural input to the appropriate muscle groups may be ensured.

In addition, one or both cameras 704 and 706 may capture locations of the marker 702 during multiple gait cycles where the marker 702 is located on a subject's knee or other portion of his/her leg to determine similarly when to actuate the foot panels 106A and 106B.

Figure 17:
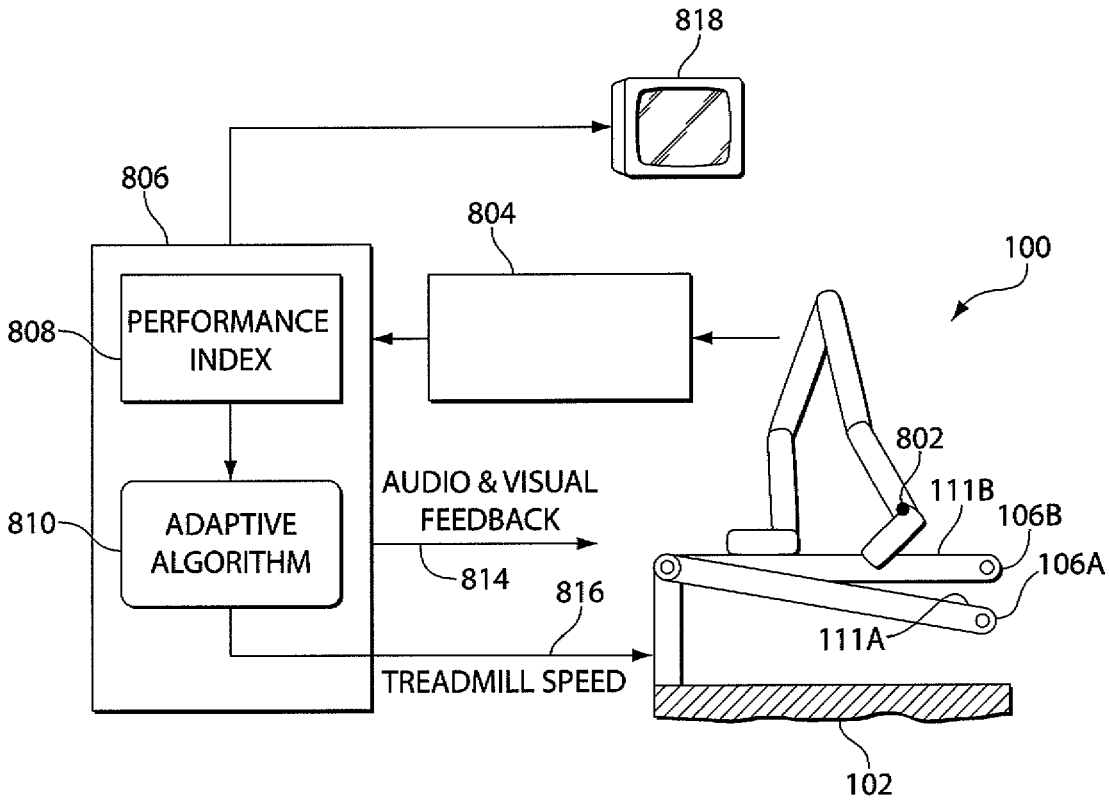
FIG. 17 is a schematic diagram of a portion of the apparatus shown in FIGS. 1 and 2, and FIGS. 7A and 7B, coupled operatively with one or more sensors, a controller, and a computer to provide performance-based gait therapy.

Referring to FIG. 17, a schematic diagram illustrates the apparatus 100 according to the invention coupled operatively with a computer 806 in a closed-loop configuration, wherein the computer 806 includes configuration and programming for use with the apparatus 100 to deliver performance-based gait therapy. The computer 806 receives data input signals 804 from one or more sensors 802, such as, for instance, the EMG sensors 607 or the cameras 704 and 706 as described above. In addition, the data input signals 804 the sensors 802 transmit to the computer 806 may represent values or variables of a subject's gait performance during therapy, and/or may represent values related to aspects of the subject's musculo-skeletal dynamics including, for instance, foot swing duration and/or step length as the subject's foot propels forward. Further, the data input signals 804 the sensors 802 transmit may represent information indicating when the subject's leg is backwards at the end of its stance phase and ready for the toe-off and when the subject's leg is at the completion of its swing phase and ready for landing or heel strike.

Any of these data input signals 804 may serve as gait performance indices in order to determine, e.g., with the computer 806, the requisite feedback control to the apparatus 100 in order to adjust, coordinate, and control gait therapy that the apparatus 100 delivers based on a subject's performance. The invention is not limited in this respect, or to the disclosed sensors 802 and data input signals 804, and envisions that any of a variety of values, variables, and/or aspects of a subject's gait performance may serve as gait performance indices and may serve to formulate and implement performance-based therapy schemes.

For instance, in one embodiment of the invention, the data input signals 804 represent the values of the step length and foot swing duration of a subject undergoing gait training, and such values serve as performance indices. The sensors 802 transmit the signals 804 to the computer 806. The computer 806 may process the input signals 804 relative to one or more performance index standards stored in the computer 806 memory in accordance with one or more adaptive algorithms. The adaptive algorithms may calculate and generate data sets of instructions that the computer 806 transmits as adaptive feedback output signals 814 and 816 to the apparatus 100. The adaptive output signals 816 that the computer 806 sends to, for instance, the walking surface/treadmill 106 may adjust and/or control the conveyor 111A and 111B speeds of the foot panels 106A and 106B in response to, for instance, the sensor-measured swing duration and step length. The invention is not so limited, or to the disclosed signals 816 and their adaptive and control effects. The invention anticipates that the computer 806 may generate other adaptive output signals 816 to adjust and/or control a range of processes and components of the apparatus 100 that may serve toward optimizing the gait therapy that the apparatus 100 delivers based on a subject's gait performance.

In addition, the computer 806 may generate visual and audio output signals 814 to the apparatus 100 and, more particularly, to a monitor or display 818 that may couple operatively with the computer 806 and/or the apparatus 100. The visual and audio output signals 814 may provide data that the display 818 shows as visual and audio content to a subject engaged in gait therapy with the apparatus 100. Such visual and audio content can provide real-time indications of a subject's gait performance, and/or identify modifications and improvements made during a current therapy session, a particular therapy session and/or over multiple therapy sessions and the performance results achieved with such modifications and improvements. The display 818 may provide the visual and audio content and images with the objectives of engaging and motivating subjects and enhancing the therapy sessions. The display 818 may present the visual and audio content during a therapy session that incorporates aspects of the therapy session as goals or objectives.

In addition, the visual and audio content the display 818 provides may be in the form and context of a video/audio game that a subject may relate to interactively during therapy. The display 818 may also provide a visual and/or audio depiction of the subject's past progress, which may be presented and incorporated in a game context whereby subjects may compete against his/her prior therapy sessions. Further, the display 818 may additionally provide visual displays or depictions of scenery or other pleasant scenes to distract subjects from an on-going therapy session.

Figure 18:
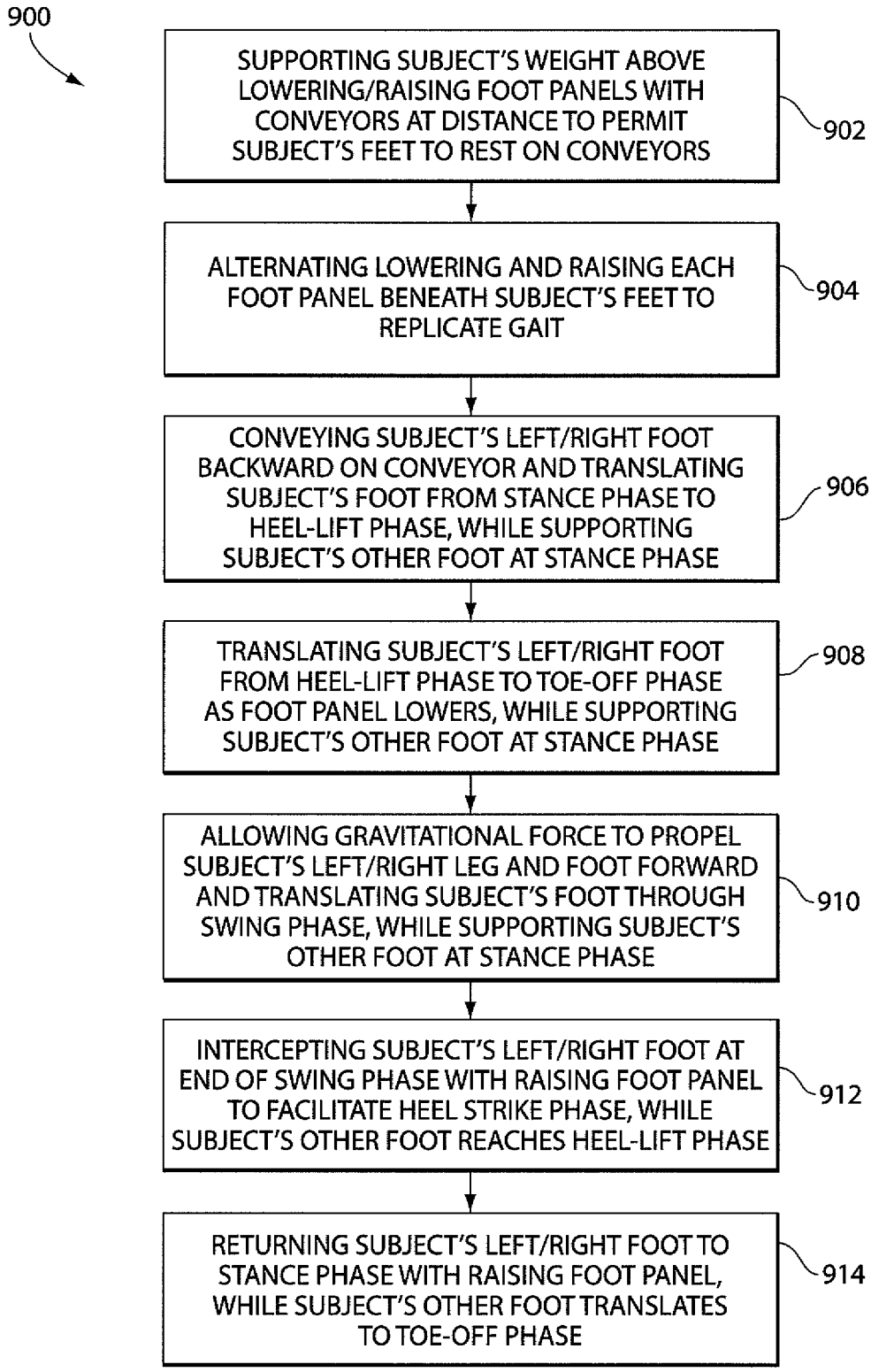
FIG. 18 is a diagram of another aspect of the invention providing a method for lower limb gait therapy for both limbs.

Referring to FIG. 18, in a further aspect, the invention provides a method 900 for lower limb rehabilitation using the apparatus 100 according to the invention as described above. The method 900, however, is exemplary only and not limiting, and is directed to gait therapy for both limbs (both legs and one or both feet) of a subject. A method according to the invention for gait therapy for a single limb (one leg and/or one foot) is illustrated in and described with reference to in FIG. 19. The method 900 may be altered, e.g., by having stages added, removed or rearranged. In addition, the stages of the method 900 illustrated in FIG. 18 and described below do not necessarily indicate any particular order or sequence of stages.

At stage 902, supporting the subject's weight, in part or completely, above lowering/raising foot panels 106A and 106B with conveyors 111A and 111B at a distance from the foot panels 106A and 106B to permit the subject's legs to relax and the subject's feet to rest on the conveyors 111A and 111B of the foot panels 106A and 106B. Each conveyor is configured 111A and 111B to convey the subject's foot in a backward direction when the subject's foot rests on the conveyor 111A and 111B surface. The foot panels 106A and 106B include two parallel foot panels 106A and 106B constructed and arranged to actuate from a stationary position, at which the subject's feet are in contact with the conveyors 111A and 111B, such that, upon activation, each foot panel 106A and 106B either lowers away from the stationary position or raises toward and returns to the stationary position. The foot panels 106A and 106B alternately lower and rise. For instance, as one foot panel 106A and 106B lowers, the other foot panel 106A and 106B rises. Activation (lowering/raising) of the panels 106A and 106B may be coordinated to help to replicate a subject's gait and/or to help to implement a performance-based therapy scheme. In one embodiment of the method 900 according to the invention, the stationary phase includes the foot panels 106A and 106B disposed in a horizontal plane substantially parallel to the surface or ground on which the apparatus 100 sits. The two parallel foot panels 106A and 106B may be actuated by an actuation system 108 coupled operatively with the foot panels 106A and 106B, and may include one or more actuators 502 to lower and raise each foot panel 106A and 106B. In one embodiment, the foot panels 106A and 106B are configured and designed to lower and rise from their respective hinged ends 205 located at the ends of the panel 106A and 106B and thereby to lower the panels 106A and 106B behind a subject's foot (heel). In a further embodiment, the foot panels 106A and 106B are not hinged and may lower and raise substantially vertically in a downward and upward manner below the subject's foot. In either embodiment, the foot panels 106A and 106B may be activated by the actuation system 108, and/or by the actuators 502 to lower and raise. In one embodiment of the method, the foot panels 106A and 106B with the conveyors 111A and 111B include a hinged, split two-panel treadmill 106.

At stage 904, alternating lowering and raising of the foot panels 106A and 106B beneath the subject's feet, such that, as one foot panel 106A lowers, the other foot panel 106B raises, to help the subject's legs and feet replicate human gait.

At stage 906, conveying the subject's left or right foot in a backward direction on the conveyor 111A and 111B. Conveying the subject's left or right foot 304 backward includes translating the subject's foot from the stance phase (a) to the heel-lift phase (b) of the subject's gait cycle as shown in FIG. 10B. As this occurs, supporting the subject's other foot at the stance phase.

At stage 908, the method includes translating the subject's left or right foot from the heel-lift phase (b) to the toe-off phase (c). Translating the subject's left or right foot from the heel-lift phase (b) to the toe-off phase (c) includes lowering the foot panel 106A in a downward direction from the stationary position and away from the subject's left or right foot. As this occurs, supporting the subject's other foot at the stance phase.

At stage 910, allowing the natural gravitational force to propel and swing the subject's left or right leg and foot forward as the foot panel 106A and 106B lowers completely away from the subject's left or right foot. As this occurs, supporting the subject's other foot at the stance phase. Allowing the gravitational force to propel and swing the subject's left or right leg and foot forward includes translating the subject's left or right foot from the toe-off phase (c) through the swing phase (d). Allowing the gravitational force to propel and swing the subject's left or right leg and foot 304 forward includes allowing the muscular and skeletal dynamics of the forward movement of the subject's left or right leg and foot to propel the subject's left or right leg and foot forward to the end of the swing phase (d). Allowing the muscular and skeletal dynamics of the forward movement of the subject's left or right leg and foot 304 to propel the subject's left or right leg and foot forward includes allowing the forward extension of the subject's hip as the subject's left or right leg and foot propels forward to the end of the swing phase (d). As this occurs, the subject's other foot is at the stance phase (a).

At stage 912, intercepting the subject's left or right foot at the end of the swing phase (d) with the raising foot panel 106A and 106B. Intercepting the subject's left or right foot with the raising the foot panel 106A and 106B includes contacting the subject's left or right heel with the raising foot panel 106A and 106B to facilitate the heel-strike phase (e). As this occurs, the subject's other foot reaches or is at the heel-lift phase (b).

At stage 9142, returning the subject's left or right foot to the stance phase (a) with the raising foot panel 106A and 106B as the raising foot panel 106A and 106B returns to the stationary position. As this occurs, the subject's other foot reaches or is at the toe-off phase (c).

Figure 19:
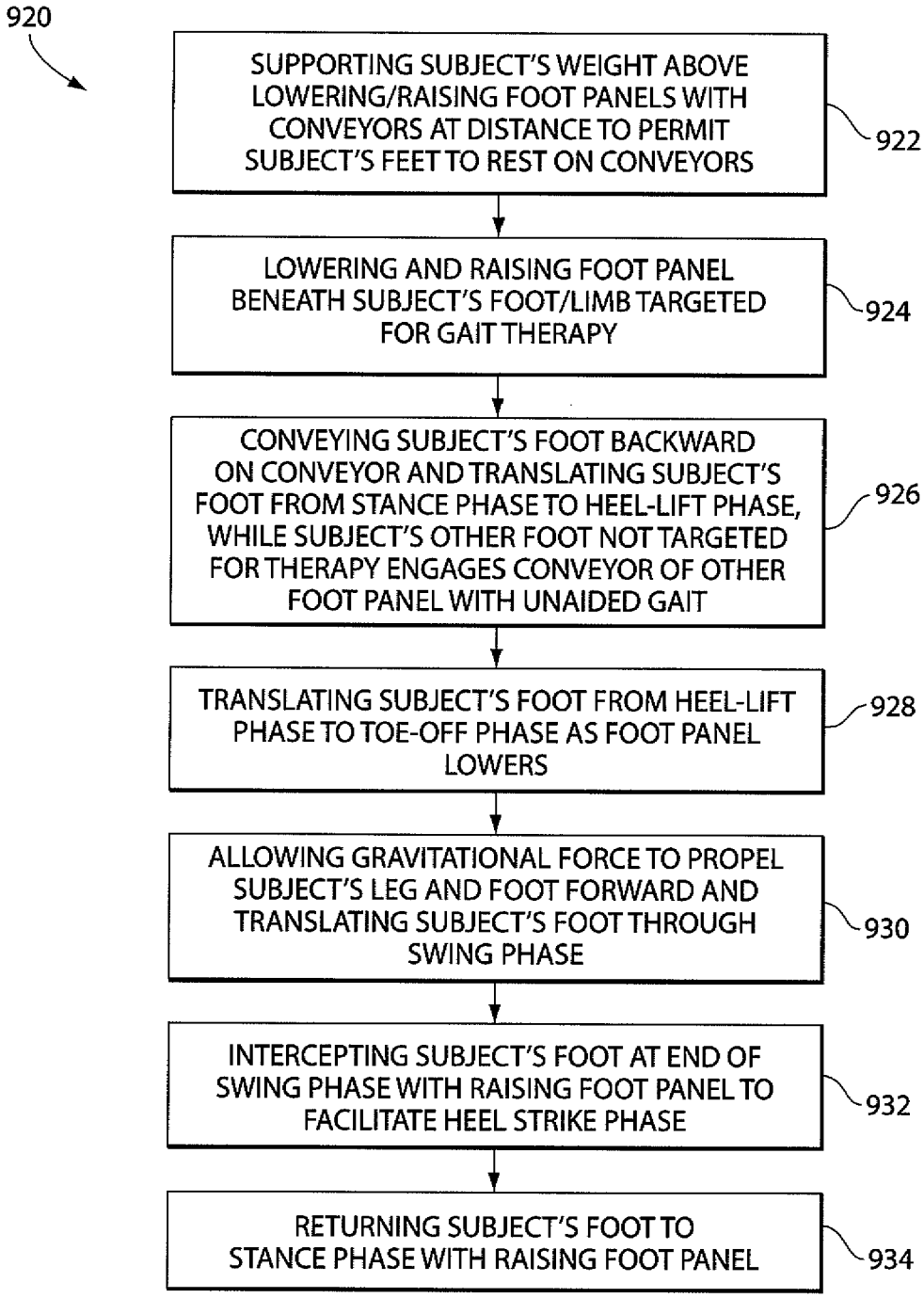
FIG. 19 is a diagram of a further aspect of the invention providing a method for lower limb gait therapy for one limb.

Referring to FIG. 19, in another aspect, the invention provides a method 920 for lower limb rehabilitation using the apparatus 100 according to the invention, as described above. The method 920, however, is exemplary only and not limiting, and is directed to gait therapy for one limb (one leg and/or one foot) of a subject. The method 920 may be altered, e.g., by having stages added, removed or rearranged. In addition, the stages of the method 920 illustrated in FIG. 19 and described below do not necessarily indicate any particular order or sequence of stages.

At stage 922, supporting the subject's weight, in part or completely, above lowering/raising foot panels 106A and 106B with conveyors 111A and 111B at a distance from the foot panels 106A and 106B to permit the subject's legs to relax and the subject's feet to rest on the conveyors 111A and 111B. Each conveyor is configured 111A and 111B to convey the subject's foot in a backward direction when the subject's foot rests on the conveyor 111A and 111B surface. One of the foot panels 106A and 106B lowers and raises below the foot of a subject's limb (leg and/or foot) targeted for gait therapy. This method 920 is configured to provide gait therapy to one leg and/or one foot of a subject. The subject's foot of his/her limb that is not targeted for therapy engages normally with the conveyor 111A and 111B and the foot panel 106A and 106B, which does not lower and raise.

At stage 924, lowering and raising the foot panel 106A and 106B beneath the subject's foot/limb targeted for gait therapy to help the subject replicate human gait in the targeted limb.

At stage 926, conveying the subject's foot in a backward direction on the conveyor 111A and 111B, while the subject's foot of the non-targeted limb engages with the conveyor 111A and 111B of the other foot panel 106A and 106B with a normal and/or unassisted/unaided gait. Conveying the subject's foot backward includes translating the subject's foot from the stance phase (a) to the heel-lift phase (b) of the limb's gait cycle as shown in FIG. 10B.

At stage 928, translating the subject's foot from the heel-lift phase (b) to the toe-off phase (c). Translating the subject's foot from the heel-lift phase (b) to the toe-off phase (c) includes lowering the foot panel 106A in a downward direction from the stationary position and away from the subject's foot.

At stage 930, allowing the natural gravitational force to propel and swing the subject's leg and foot forward as the foot panel 106A and 106B lowers completely away from the subject's foot 304. Allowing the gravitational force to propel and swing the subject's leg and foot forward includes translating the subject's foot from the toe-off phase (c) through the swing phase (d). Allowing the gravitational force to propel and swing the subject's foot forward includes allowing the muscular and skeletal dynamics of the forward movement of the subject's leg and foot to propel the subject's leg and foot forward to the end of the swing phase (d). Allowing the muscular and skeletal dynamics of the forward movement of the subject's leg and foot to propel the subject's leg and foot forward includes allowing the forward extension of the subject's hip as the subject's leg and foot propels forward to the end of the swing phase (d).

At stage 932, intercepting the subject's foot at the end of the swing phase (d) with the raising foot panel 106A and 106B. Intercepting the subject's foot 304 with the raising the foot panel 106A and 106B includes contacting the subject's heel with the raising foot panel 106A and 106B to facilitate the heel-strike phase (e).

At stage 934, returning the subject's foot to the stance phase (a) with the raising foot panel 106A and 106B as the foot panel 106A and 106B returns to the stationary position.

Figure 20:
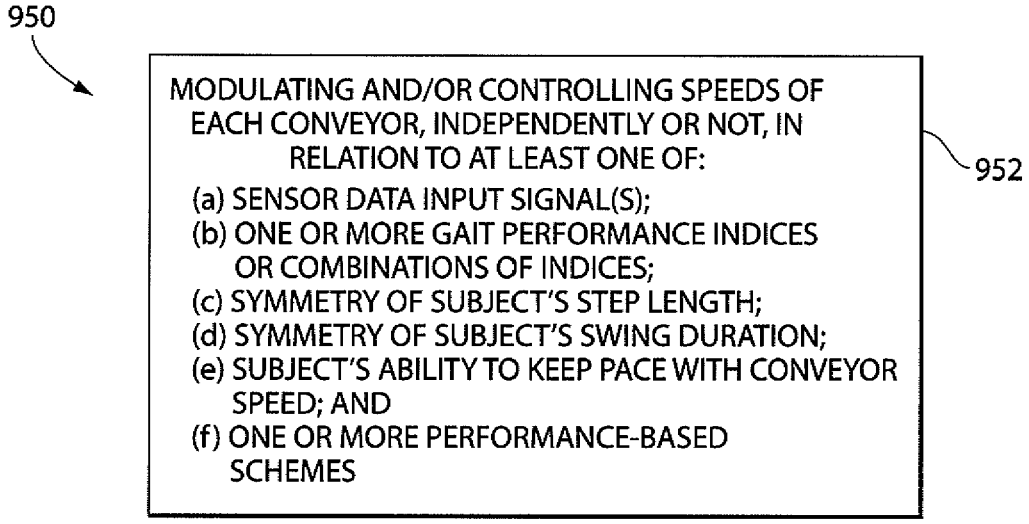
FIG. 20 is a diagram of a method according to another aspect of the invention for conveyor speed control in relation to the methods shown in FIGS. 18 and 19, and FIGS. 21 and 22.

Referring to FIG. 20, in a further aspect, the invention provides a method 950 for lower limb rehabilitation using the apparatus 100 according to the invention, as described above. The method 950, however, is exemplary only and not limiting, and includes any of the phases 902 thru 914 described above with reference to FIG. 18, or any of the phases 922-934 described above with reference to FIG. 19. The method 950 may be altered, e.g., by having stages added, removed or rearranged. In addition, the stages of the method 950 illustrated in FIG. 20 and described below do not necessarily indicate any particular order or sequence of stages.

At stage 952, the method includes adjusting, controlling, and/or modulating speeds of each conveyor 111A and 111B of the foot panels 106A and 106B, independently or not, in relation to at least one of: (a) one or more data input signals received from one or more sensors; (b) one or more gait performance indices and combinations of indices; (c) the symmetry of a subject's step length; (d) the symmetry of a subject's swing duration; (e) a subject's ability to keep pace with a conveyor speed; and (f) one or more performance-based schemes.

Figure 21:
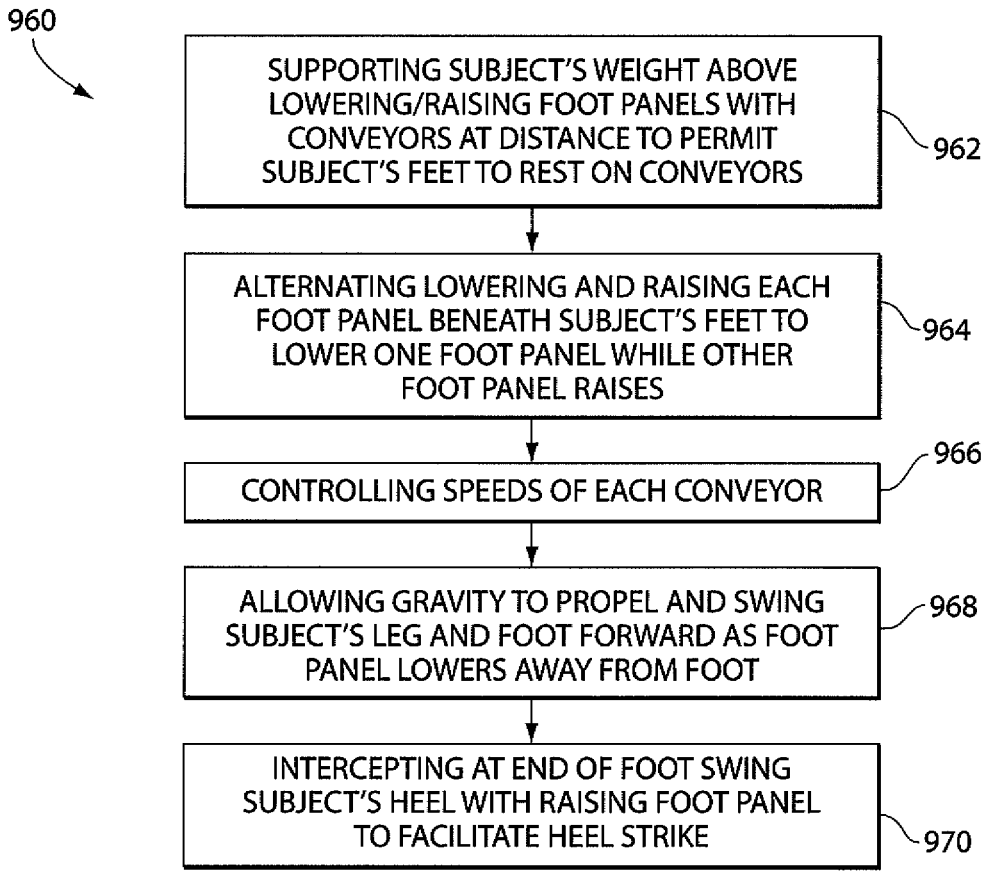
FIG. 21 is a diagram of a method according to a further aspect of the invention providing a method for lower limb gait therapy for both limbs.

Referring to FIG. 21, in a further aspect, the invention provides a method 960 for lower limb rehabilitation using the apparatus 100 according to the invention, as described above. The method 960, however, is exemplary only and not limiting, and is directed to gait therapy for both limbs (both legs and one or both feet) of a subject. A method according to the invention for gait therapy for a single limb (one leg and/or one foot) is illustrated in and described with reference to in FIG. 22. The method 960 may be altered, e.g., by having stages added, removed or rearranged. In addition, the stages of the method 960 illustrated in FIG. 21 and described below do not necessarily indicate any particular order or sequence of stages.

At stage 962, supporting the subject's weight, in part or completely, above lowering/raising foot panels 106A and 106B with conveyors 111A and 111B at a distance from the foot panels 106A and 106B to permit the subject's legs to relax and the subject's feet to rest on the conveyors 111A and 111B. Each conveyor is configured 111A and 111B to convey the subject's foot in a backward direction when the subject's foot rests on the conveyor 111A and 111B surface.

At stage 964, the method includes alternating lowering and raising each foot panel 106A and 106B below each of the subject's feet. Alternating lowering and raising each foot panel 106A and 106B includes lowering one foot panel 106A and 106B while raising the other foot panel 106A and 106B.

At stage 966, controlling speeds of each conveyor 111A and 111Bs. Controlling speeds of each conveyor 111A and 111B may include the phase 952 of the method 950 illustrated in and described with reference to FIG. 20.

At stage 968, allowing each of the subject's leg and foot to propel and swing forward as the foot panel 106A and 106B below the subject's foot lowers away from the foot.

At stage 970, intercepting each of the subject's feet with the fool panel 106A and 106B raising below the subject's foot, such that, the raising foot panel 106A and 106B and the subject's foot contact to facilitate heel strike.

Figure 22:
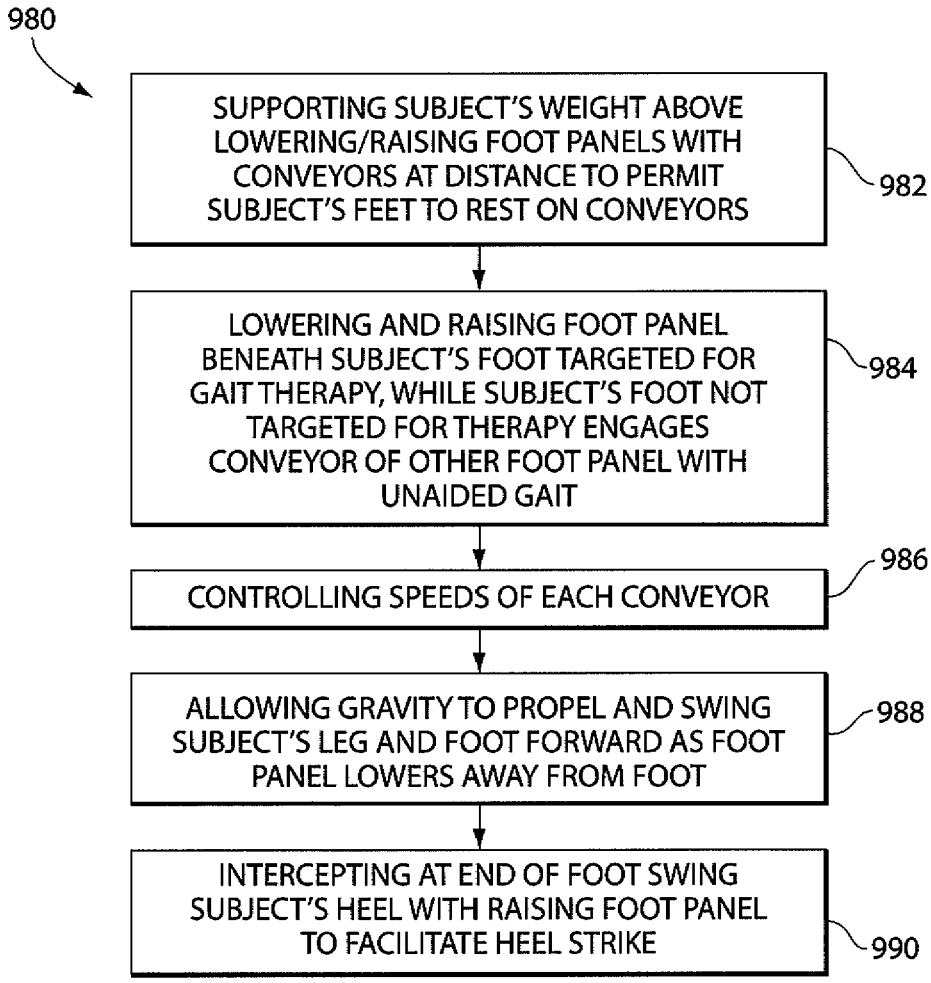
FIG. 22 is a diagram of a method according to another aspect of the invention providing a method for lower limb gait therapy of one limb.

Referring to FIG. 22, in another aspect, the invention provides a method 980 for lower limb rehabilitation using the apparatus 100 according to the invention, as described above. The method 980, however, is exemplary only and not limiting, and is directed to gait therapy for one limb (one leg and/or one foot) of a subject. The method 980 may be altered, e.g., by having stages added, removed or rearranged. In addition, the stages of the method 980 illustrated in FIG. 22 and described below do not necessarily indicate any particular order or sequence of stages.

At stage 982, supporting the subject's weight, in part or completely, above lowering/raising foot panels 106A and 106B with conveyors 111A and 111B at a distance from the foot panels 106A and 106B to permit the subject's legs to relax and the subject's feet to rest on the conveyors 111A and 111B. Each conveyor is configured 111A and 111B to convey the subject's foot in a backward direction when the subject's foot rests on the conveyor 111A and 111B surface.

At stage 984, the method includes lowering and raising the foot panel 106A and 106B below the subject's foot of the limb targeted for gait therapy, while the subject's foot of the non-targeted limb engages with the conveyor 111A and 111B of the other foot panel 106A and 106B with a normal and/or unassisted/unaided gait.

At stage 986, controlling speeds of the conveyors 111A and 111B. Controlling speeds of each conveyor 111A and 111B may include the phase 952 of the method 950 illustrated in and described with reference to FIG. 20.

At stage 988, allowing the subject's leg and foot to propel and swing forward as the foot panel 106A and 106B below the subject's foot lowers away from the foot.

At stage 990, intercepting the subject's foot with the fool panel 106A and 106B raising below the subject's foot, such that, the raising foot panel 106A and 106B and the subject's foot contact to facilitate heel strike.

Other aspects and embodiments of the apparatus 100 and method disclosed herein are within the scope of the invention. For example, while the BWS system 104 is substantially passive, the BWS system 104 may be constructed and arranged to provide a more adjustable passive body weight support or to serve as an active body weight support. As another example, the apparatus 100 may be constructed and arranged to incorporate other therapy devices that provide other necessary degrees of freedom for lower body rehabilitation, such as enabling degrees of freedom of the hips and to actuate ankle movements.

Having thus described at least one illustrative embodiment of the inventions, various alterations, substitutions, modifications and improvements in form and detail will readily occur to those skilled in the art without departing from the scope of the inventions. Such alterations, substitutions, modifications and improvements are intended to be within the scope and spirit of the inventions. Other aspects, functions, capabilities, and advantages of the inventions are also within their scope. Accordingly, the foregoing description is by way of example only and is not intended as limiting.

In addition, in describing aspects of the invention, specific terminology is used for the sake of clarity. For purposes of description, each specific term is intended to at least include all technical and functional equivalents that operate in a similar manner to accomplish a similar purpose. In some instances where a particular aspect of the invention includes a plurality of system elements or method steps, those elements or steps may be replaced with a single element or step; likewise, a single element or step may be replaced with a plurality of elements or steps that serve the same purpose. Further, where parameters for various properties are specified herein for aspects of the inventions, those parameters can be adjusted or rounded-off to approximations thereof within the scope of the invention, unless otherwise specified.

What is claimed is:

1. A method of lower limb gait therapy, the method comprising:

providing a first lowering and rising foot panel having a first conveyor and a second lowering and rising foot panel having a second conveyor, the foot panels and conveyors being coupled to an actuation system for actuating the foot panels and conveyors;

providing a controller operating associated with the actuation system and configured to control the lowering and raising of the first foot panel and second foot panel, and receive information measured by a sensor, the information characterizing a leg position of a subject;

supporting a subject's weight at a distance above the first lowering and rising foot panel and the second lowering and rising foot panel, such that a first foot of the subject is able to be in contact with and rest on the first conveyor while a second foot of the subject is able to be in contact with and rest on the second conveyor;

lowering the first foot panel when a first leg supported thereon is at the end of a stance phase causing the first foot to separate from the first conveyor thereby permitting at least gravity to propel the separated first foot and the corresponding first leg of the subject forward relative to the subject without encumbrance in a swing motion, while simultaneously conveying, using the second conveyor, the second foot in a backward direction relative to the subject;

determining, based at least on the received information measured by a sensor and characterizing the leg position of the subject, when to raise the first foot panel such that the first foot reestablishes contact with the first conveyor in a heel strike;

raising the lowered first foot panel to re-establish contact with the separated and swinging first foot;

controlling speeds of one or both conveyors; and controlling the lowering and raising of one or both foot panels.

2. The method of claim 1 wherein controlling speeds of one or both conveyors includes adjusting speeds in real-time in response to data provided by one or more input signals received from at least one sensor coupled with one or both foot panels, the at least one sensor being disposed and being configured to monitor movement of at least one of: one or both of the subject's feet and one or both of the subject's legs.

3. The method of claim 2 wherein adjusting speeds of one or both conveyors includes adjusting speeds, such that, conveyors operate at the same speeds or at different speeds.

4. The method of claim 2 wherein adjusting speeds of one or both conveyors includes adjusting speeds of each conveyor independently or simultaneously.

5. The method of claim 1 wherein controlling the lowering and raising of one or both conveyors includes controlling the impedance between at least one conveyor and the subject's foot.

6. The method of claim 1 wherein controlling speeds of one or both conveyors includes adjusting speeds in real-time in response to the subject's gait performance.

7. The method of claim 2 wherein the at least one sensor includes an electromyography (EMG) electrode placed on or in at least one given muscle or a given group of muscles of at least one of: one or both of the subject's feet and one or both of the subject's legs, to measure electromyographical signals of the given muscle or the given group of muscles.

8. The method of claim 7 wherein adjusting speeds of one or both conveyors includes adjusting speeds relative to recorded electromyographical signals of the given muscle or the given group of muscles.

9. The method of claim 2 wherein the one or more input signals the at least one sensor provides represent information indicating the position of at least one of: one or both of the subject's feet and one or both of the subject's legs, relative to the conveyor.

10. The method of claim 2 wherein the one or more input signals received from the at least one sensor provides representative information related to at least one of: (i) the subject's gait speed, (ii) foot swing velocity of at least one of the subject's feet, (iii) foot swing duration of at least one of the subject's feet, and (iv) step length of at least one of the subject's feet.

11. The method of claim 10 wherein adjusting speeds of one or both conveyors includes adjusting speeds based on at least one of: (i) the subject's gait speed, (ii) foot swing velocity of at least one of the subject's feet, (iii) foot swing duration of at least one of the subject's feet, and (iv) step length of at least one of the subject's feet.

12. The method of claim 10 wherein adjusting speeds of one or both conveyors includes adjusting speeds based on at least one of: (i) the symmetry of the step length between the subject's feet, (ii) the symmetry of the foot swing duration between the subject's feet, and (iii) the ability of the subject to maintain gait at the conveyor speeds.

13. The method of claim 9 wherein the at least one sensor includes at least one camera disposed in relation to at least one of the subject's feet as the subject is supported above the foot panels to track a position of a marker along the subject's foot.

14. The method of claim 9 wherein the at least one sensor includes at least one camera disposed in relation to the subject supported above the foot panels to track a position of one or more markers along at least one of: at least one of the subject's feet and the subject's respective thigh.

15. The method of claim 1 wherein controlling the lowering and raising of one or both foot panels includes adjusting the lowering and raising of one or both foot panels in real-time in response to data provided by one or more input signals received from at least one sensor disposed relative to one or both foot panels.

16. The method of claim 15 wherein adjusting the lowering and raising of one or both foot panels includes adjusting and controlling at least one of: (i) lowering speeds of the foot panel, (ii) raising speeds of the foot panel, (iii) frequency of actuation of the foot panel to lower or rise, and (iv) the contact impedance of the foot panel and the subject's foot.

17. A method of lower limb gait therapy, the method comprising:

providing a lowering and rising foot panel having a conveyor, the lowering and rising foot panel coupled to an actuation system;

providing a controller operating associated with the actuation system and configured to control the lowering and raising of the foot panel and receive information measured by a sensor and characterizing a leg position of a subject;

supporting at least part of the subject's weight, the subject positioned substantially above the lowering and rising foot panel having a conveyor, such that, a first foot of the subject is able to rest on the conveyor of the foot panel in a first position;

lowering the foot panel behind the subject's first foot when the first leg supported thereon is at the end of a stance phase causing the first foot to separate from the conveyor and permitting the corresponding leg of the subject and the first foot to propel forward a distance in a swinging motion to a second position, the corresponding leg and the first foot being propelled by at least gravity;

determining, based at least on the received information measured by a sensor and characterizing the leg position of the subject, when to raise the foot panel such that the first foot reestablishes contact with the conveyor in a heel strike;

raising the foot panel after the leg has swung the distance causing the first foot to re-establish contact with the conveyor; and conveying, using the conveyor, the first foot to substantially the first position such that the foot remains in contact with the conveyor during the conveying.

* * * * *